US011511182B2

(12) United States Patent
Stellenberg et al.

(10) Patent No.: US 11,511,182 B2
(45) Date of Patent: Nov. 29, 2022

(54) DEPLOYING COMPONENTS IN A PINBALL MACHINE

(71) Applicant: Multimorphic, Inc., Austin, TX (US)

(72) Inventors: Gerald Stellenberg, Austin, TX (US); Leslie Pitt, Austin, TX (US)

( * ) Notice: Subject to any disclaimer, the term of this patent is extended or adjusted under 35 U.S.C. 154(b) by 0 days.

(21) Appl. No.: 13/777,865

(22) Filed: Feb. 26, 2013

(65) Prior Publication Data

US 2013/0181399 A1 Jul. 18, 2013

Related U.S. Application Data

(63) Continuation-in-part of application No. 13/734,151, filed on Jan. 4, 2013.

(60) Provisional application No. 61/632,002, filed on Jan. 17, 2012, provisional application No. 61/632,749, filed on Jan. 31, 2012, provisional application No. 61/633,559, filed on Feb. 14, 2012, provisional application No. 61/634,352, filed on Feb. 28, 2012, provisional application No. 61/685,588, filed on Mar.

(Continued)

(51) Int. Cl.
*A63F 7/02* (2006.01)
*A63F 7/24* (2006.01)

(52) U.S. Cl.
CPC ..... *A63F 7/025* (2013.01); *A63F 7/027* (2013.01); *A63F 7/2409* (2013.01); *A63F 7/2481* (2013.01)

(58) Field of Classification Search
CPC ..... A63D 3/02; A63F 7/02; A63F 7/30
USPC ..... 273/119 A, 119 R, 121 A, 127 R, 129 V, 273/118 R, 127 D; 345/175
See application file for complete search history.

(56) References Cited

U.S. PATENT DOCUMENTS 3,897,951 A * 8/1975 Morrison ..... A63F 7/025 273/124 A
4,269,413 A * 5/1981 Langieri ..... A63F 7/26 273/DIG. 26

(Continued)

OTHER PUBLICATIONS

Pinball News, P3 Pinball Platform, published on Mar. 23, 2012 at http://www.pinballnews.com/learn/p3, last accessed on Dec. 28, 2012.

(Continued)

*Primary Examiner* — Eugene L Kim
*Assistant Examiner* — Christopher Glenn
(74) *Attorney, Agent, or Firm* — Braxton Perrone, PLLC; Bobby W. Braxton; Gregory Perrone

(57) ABSTRACT

Systems and methods for deploying components within pinball machines. In some embodiments, a device may include a physical object coupled to an actuator via a flexible link, the physical object configured to interact with a pinball within a playfield of a pinball machine under control of the actuator. In other embodiments, a pinball machine may include a physical object configured to directly or indirectly interact with a pinball during a pinball game, the physical object coupled to an area within a playfield of the pinball machine other than a playable surface accessible to the pinball during a pinball game, the physical object suspended above the playable surface. In yet other embodiments, a pinball machine may include a plastic playfield cover configured to cover a playfield of the pinball machine, the plastic playfield cover configured to provide a player with access to one or more physical objects within the playfield.

17 Claims, 14 Drawing Sheets

Related U.S. Application Data

21, 2012, provisional application No. 61/685,644, filed on Mar. 22, 2012.

(56) References Cited

U.S. PATENT DOCUMENTS 4,542,905 A * 9/1985 Hooker ..... A63F 7/3065 473/192
4,568,085 A * 2/1986 Tate ..... A63F 7/3065 273/127 D
4,606,545 A * 8/1986 Ritchie ..... A63F 7/027 273/121 A
4,805,906 A * 2/1989 Wiczer et al. ..... 273/119 A
4,840,375 A * 6/1989 Lawlor et al. ..... 273/121 A
4,872,687 A * 10/1989 Dooley ..... A63B 24/0021 473/184
4,971,323 A * 11/1990 Gottlieb ..... A63F 7/027 273/121 A
5,316,303 A * 5/1994 Trudeau et al. ..... 273/121 A
5,351,954 A * 10/1994 Oursler ..... A63F 7/027 273/127 R
5,383,663 A * 1/1995 Anghelo ..... A63F 7/027 273/121 A
5,516,103 A * 5/1996 Lawlor ..... A63F 7/3065 273/127 R
5,961,116 A * 10/1999 Beyer ..... 273/119 R
6,036,188 A 3/2000 Gomez
6,036,189 A * 3/2000 Gomez ..... A63F 7/027 273/127 R
7,946,585 B2 * 5/2011 Grist ..... A63F 7/025 273/121 D
2008/0231611 A1 * 9/2008 Bathiche ..... A63F 13/00 345/175
2009/0085286 A1 * 4/2009 Grist ..... A63F 7/025 273/127 R

OTHER PUBLICATIONS

Pinball News, P3 Update:Team Adds New Game Designer, published on Dec. 5, 2012 at http://www.pinballnews.com/games/p3/index4.html, last accessed on Dec. 28, 2012.

* cited by examiner

DEPLOYING COMPONENTS IN A PINBALL MACHINE

CROSS-REFERENCE TO RELATED APPLICATIONS

The present application claims priority to, and is a continuation-in-part (CIP) of, U.S. patent application Ser. No. 13/734,151 filed on Jan. 4, 2013, which claims the priority of U.S. Provisional Patent Application No. 61/632,002 filed on Jan. 17, 2012, of U.S. Provisional Patent Application No. 61/632,749 filed on Jan. 31, 2012, and of U.S. Provisional Patent Application No. 61/633,559 filed on Feb. 14, 2012, the disclosures of which are hereby incorporated by reference herein in their entirety. The present application also claims priority to: U.S. Provisional Patent Application No. 61/634,352 filed on Feb. 28, 2012, U.S. Provisional Patent Application No. 61/685,588 filed on Mar. 21, 2012, and U.S. Provisional Patent Application No. 61/685,644 filed on Mar. 22, 2012, the disclosures of which are hereby further incorporated by reference herein in their entirety.

FIELD

This document relates generally to gaming devices, and more specifically, systems and methods for deploying components within a pinball machine.

BACKGROUND

A pinball machine is an entertainment or amusement device usually found in a variety of public places such as arcades, restaurants, bars, clubs, etc., but sometimes also present in private residences and other environments. Generally speaking, a conventional or traditional pinball machine allows players to play a game in which points are earned by physically manipulating one or more steel balls on a slightly inclined playfield within a glass-covered cabinet.

The pinball machine's playfield typically includes one or more physical targets. When a ball strikes a particular physical target, an electromechanical switch coupled to (or otherwise integrated into) the target detects the mechanical impact, which then triggers a change in some aspect of the game. For example, in some cases, when a ball hits a given target, a player may score a predetermined amount of points.

In most pinball implementations, a "hole" or "drain" is located at the bottom portion of the playfield. Usually, if the ball falls into the drain, the game ends or another ball is provided to the player. Mechanical "flippers" capable of at least partially covering the drain may allow a skilled player to hit the ball at an appropriate time so as to prevent it from falling into the drain, thus putting that same ball back in play and extending the duration of the game.

SUMMARY

Pinball machines having physical objects within hybrid playfields are described. In an illustrative, non-limiting embodiment, a device may include a physical object coupled to an actuator via a flexible link, the physical object configured to directly or indirectly interact with a pinball within a playfield of a pinball machine under control of the actuator. The actuator may include a motor or plunger having an electromagnetic coil or solenoid, and the flexible link may include a wire, rope, or cable. The device may also include a tensioning device configured to modify a tension of the link.

In some implementations, the physical object may be a flipper or a slingshot. The flipper or slingshot may be coupled to a portion of the pinball machine other than one or more playable surfaces accessible to the pinball during a pinball game. Additionally or alternatively, the flipper or slingshot may be suspended above an electronic display within the playfield. Additionally or alternatively, the actuator may be configured to move the physical object in response to a virtual object being present or absent from the electronic display during a pinball game.

In another illustrative, non-limiting embodiment, a pinball machine may include a physical object configured to directly or indirectly interact with a pinball during a pinball game, the physical object coupled to an area within a playfield of the pinball machine other than a playable surface accessible to the pinball during a pinball game, the physical object suspended above the playable surface. The physical object may include a post, flipper, slingshot, target, or rail. Further, the physical object may be coupled to the area of the playfield via a component selected from the group consisting of: an arm, mount, plate, and bracket.

In some cases, the playable surface may be an approximately horizontal surface having an electronic display visible to a player during the pinball game, the electronic display configured to render one or more virtual objects in response to a movement of the physical object. Also, the component may include a transparent or translucent portion located above the electronic display. Additionally or alternatively, the area within the playfield to which the physical object is coupled may include an intermediate surface approximately parallel to the playable surface, the intermediate surface including a transparent or translucent portion located above the electronic display.

The pinball machine may also include a tracking system having one or more transducers configured to determine a location, speed, or direction of movement of the pinball, the component configured to position the physical object above the one or more transducers. The area within the playfield to which the physical object is coupled may include a playfield cover or lid, and wherein the playfield cover or lid is plastic. The pinball machine may also include an actuator coupled to the physical object via a flexible link, the physical object configured to move within the playfield under control of the actuator.

In yet another illustrative, non-limiting embodiment, a pinball machine may include a plastic playfield cover configured to cover a playfield of the pinball machine, the plastic playfield cover configured to provide a player with access to one or more physical objects within the playfield. The pinball machine may also include a hinge configured to couple the plastic playfield cover to a cabinet of the pinball machine. The pinball machine may further include a physical object and an actuator coupled to the physical object via a flexible link, the physical object configured to directly or indirectly interact with a pinball during a pinball game by moving within the playfield under control of the actuator, the physical object coupled to an area within the playfield other than a playable surface accessible to the pinball during a pinball game, the physical object suspended above the playable surface.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods disclosed herein are directed to pinball machines with hybrid playfields and methods of operating the same. Generally speaking, some of these systems and methods may be incorporated into, or otherwise combined with, a wide range of other entertainment or amusement devices, including, but not limited to, video games, electro-mechanical games, redemption games, merchandisers, billiards, shuffleboards, table football ("Foosball"), table tennis ("Ping-Pong"), air hockey tables, etc. These systems and methods may also be incorporated into gambling devices, such as slot machines, pachinko machines, or the like. It should be noted, however, that some of the techniques discussed herein may be uniquely applicable to devices that allow a player to manipulate a physical object within a playfield without directly touching that physical object (e.g., pinball machines).

Figure 1:
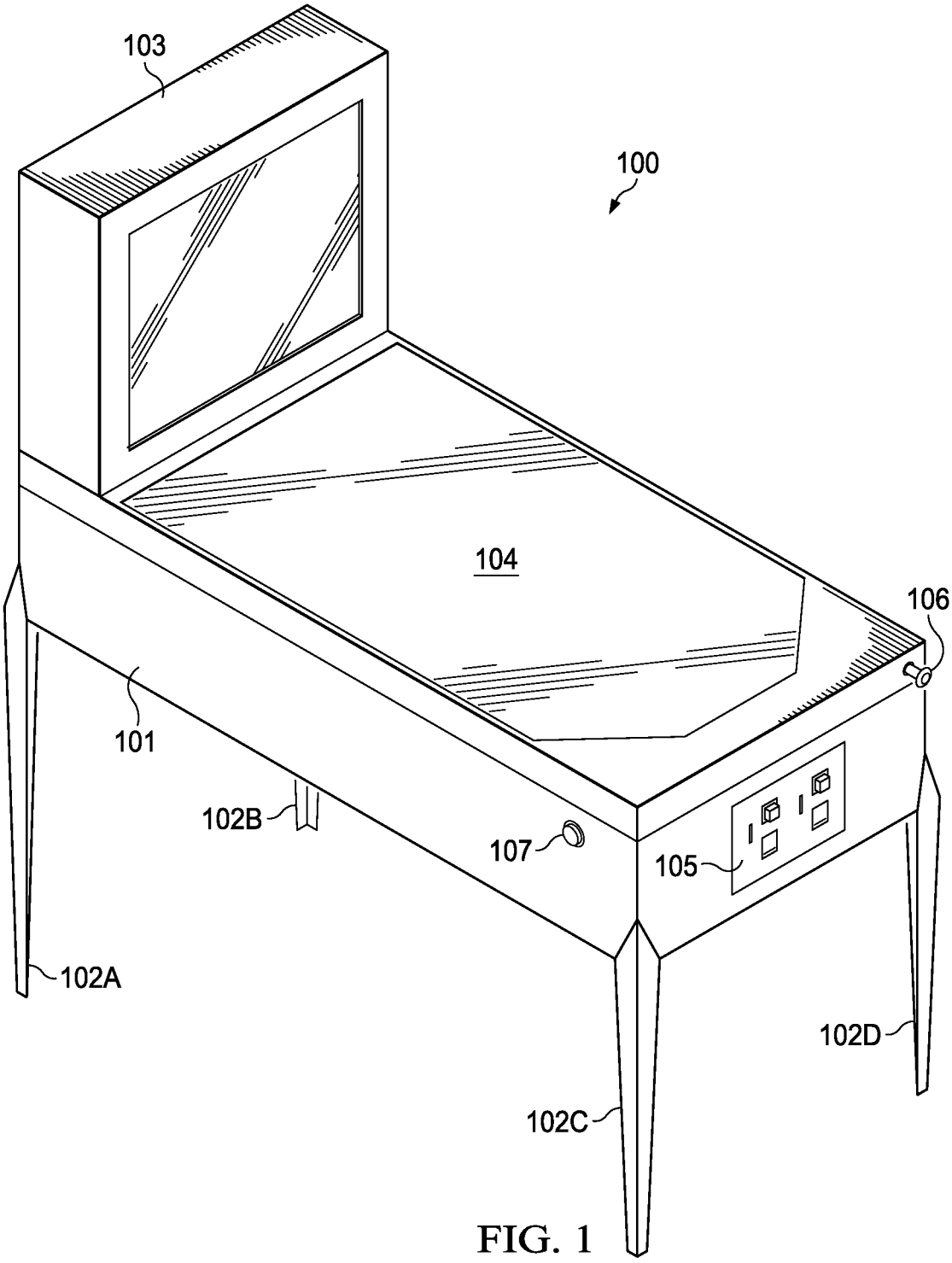
FIG. 1 is a three-dimensional, auxiliary view of an example of a pinball machine according to some embodiments.

Turning to FIG. 1, a three-dimensional, auxiliary view of an example of pinball machine 100 is depicted according to some embodiments. As illustrated, cabinet 101 stands on legs 102A-D, although in other implementations legs 102A-D may be absent and cabinet 101 may sit on a stand, desk, table, countertop, or the like. Cabinet 101 includes hybrid playfield 104, where a game of pinball may take place. Examples of hybrid playfield 104 are discussed in more detail below. In some cases, legs 102A and 102B may be slightly longer than legs 102C and 102D, such that playfield 104 may have an angle of approximately 3.5° to 10.5° with respect to the ground ("pitch"). Accordingly, playfield 104 may be said to have an approximately horizontal surface. In other cases, legs 102A-D may each have the same length, and cabinet 101 may be constructed so as to provide a suitable pitch to hybrid playfield 104.

Vertical portion 103 may include one or more electronic displays, video cameras, loudspeakers, etc. Generally speaking, vertical portion 103 may include or otherwise present certain audio-visual information, whether related or unrelated to a pinball game playable on machine 100 (e.g., promotional or marketing materials, etc.).

To enable a player to play a pinball game, front control(s) 105 may allow the user or player to deposit money or tokens into machine 100. As such, front control(s) 105 may include, for example, a credit, coin or token receiver, a magnetic card reader, a Radio Frequency Identification (RFID) scanner, or the like. Front control(s) 105 may also include one or more buttons that allow a user to select a number of players for a particular game, or to simply to start a pinball game. Meanwhile, side control(s) 107 and playfield control(s) 106 allow the user to operate one or more physical objects within hybrid playfield 104. As an example, side control(s) 107 (and/or a corresponding control on the opposite side of cabinet 101, not shown) may include one more buttons that allow a player to control mechanical "flippers." As another example, playfield control(s) 106 may include one or more buttons or mechanisms that allow the player to control a "plunger" element configured to put a steel ball in play during a pinball game.

Here it should be noted that pinball machine 100 is provided by way of illustration only. In different applications, machine 100 may assume a variety of shapes and forms. Furthermore, one or more components discussed above may be absent or different from what is depicted in FIG. 1. For example, in some cases, front control(s) 105 may be located elsewhere on machine 100, and, in other cases, may include more or fewer elements than shown. For instance, when designed for residential or personal use, machine 100 may not be credit, coin or token-operated. Similarly, side control(s) 107 and/or playfield control(s) 106 may be replaced with motion detection devices (e.g., integrated into vertical portion 103), or may not be necessary for certain games. For example, if steel balls are provided within playfield 104 via an internal mechanism within machine 100, then playfield control(s) 106 may not be necessary.

Figure 2:
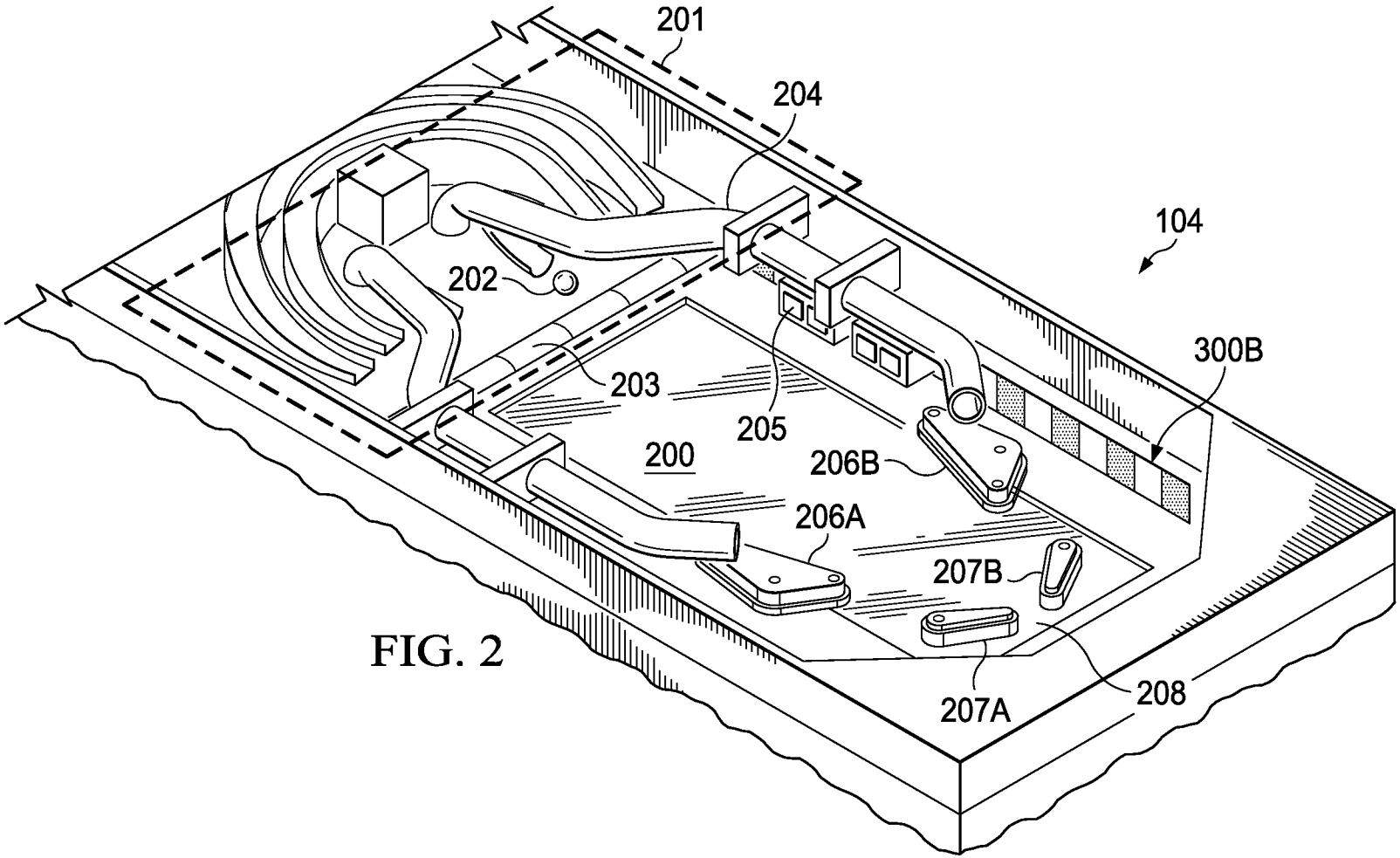
FIG. 2 is a three-dimensional, auxiliary view of an example of a hybrid playfield according to some embodiments.

FIG. 2 is a three-dimensional, auxiliary view of an example of hybrid playfield 104 according to some embodiments. Generally speaking, a "playfield" is a mostly flat surface over which one or more objects, such as ball 202, move in an amusement game, such as a pinball game. Hybrid playfield 104 is a playfield comprising a "physical space" and a "virtual space." The physical space may include one or more mechanical or electromechanical elements, also referred to herein as "physical objects." Electronic display 200 may provide the virtual space portion of hybrid playfield 104 by rendering one or more graphical elements referred to herein as "virtual objects."

In the case of a pinball machine, examples of hybrid playfield 104's physical objects include, but are not limited to, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc. Meanwhile, virtual objects may include any graphical or digital element that may be rendered on electronic display 200, such as, for example, artwork, colors, images, animations, photographs, designs, etc.

In various implementations, systems and methods described herein may allow certain physical objects to cause changes to certain virtual objects and/or vice-versa. Accordingly, these systems and methods may create an impression or an illusion upon a player that physical and virtual elements are interacting during a game, for example, in a physical or mechanical manner.

In the illustrated embodiment, hybrid playfield 104's physical objects include modular portion 201 configured to deploy one or more ball(s) 202 onto the playfield during a game. In this example, modular portion 201 includes barrier element(s) 203 and pipe element(s) 204. Barrier element(s) 203 may include one or more walls that can pop-up and at least partially block ball 202 from transiting between modular portion 201 and other portion(s) of hybrid playfield 104. In some cases, barrier element(s) 203 may act as a "trap" to cause ball 202 to fall under the surface of hybrid playfield 104 or become more or less static for a predetermined amount of time (e.g., by including an electromagnet or the like), for example. Meanwhile, pipe element(s) 204 may allow ball 202 to travel through predetermined paths or "shortcuts" when traveling within hybrid playfield 104.

Once deployed, ball 202 may tend to roll towards drain 208 depending upon the pitch of playfield 104 and absent action by a player operating flippers 207A and/or 207B. Flippers 207A and/or 207B are mechanically or electromechanically-controlled levers used for redirecting ball 202 up playfield 104, preventing ball 202 from falling into drain 208. Through the use of careful, skillful timing, a player may also be to manipulate flippers 207A and/or 207B to intentionally direct ball 202 in a selected direction with a given speed, thus causing ball 202 to hit various types of scoring targets, such as, for example, one or more trigger elements 205 and/or slingshots 206A and 206B.

With respect to hybrid playfield 104's virtual objects, electronic display 200 may be any suitable display or monitor (e.g., a Liquid Crystal Display (LCD) or the like) configured to present graphical designs and/or animations to a player. These virtual objects are configurable depending upon the design of a game, and may interact with certain physical objects in hybrid playfield 104. In some implementations, electronic display 200 may be capable of rendering 2D virtual objects on a flat screen. Additionally or alternatively, electronic display 200 may be capable of producing 3D and/or holographic virtual objects.

Although shown as a single display in FIG. 2, in other embodiments two or more electronic displays 200 may be disposed in playfield 104. For example, in some cases, a first electronic display and a second electronic display may be positioned side-by-side. In other cases, four electronic displays may be arranged such that each occupies a different quadrature of playfield 104. Furthermore, in some cases, electronic display 200 may be at least in part co-extensive with the surface of hybrid playfield 104.

As discussed in more detail below, ball 202 may cause one or more virtual objects rendered by electronic display 200 to appear, disappear, or change depending upon its position on hybrid playfield 104. Similarly, when ball 202 physically interacts with trigger element 205 and slingshots 206A and 206B, for example, one or more virtual objects presented on electronic display 200 may change their behavior in an appropriate manner. Conversely, virtual objects rendered on electronic display 200 may also behave in a way so as to cause a change in one or more of trigger element 205 and slingshots 206A and 206B, for example, thus appearing to a player as if a physical interaction between the virtual object and the physical object has taken place.

In some cases, in order to enable one or more of the foregoing operations, a tracking system may be disposed within machine 100 to determine a position of ball 202 and/or other physical objects. For instance, one or more arrays of infrared (IR) transducers may be disposed immediately above the surface of hybrid playfield 104 along one or more sides of electronic display 200.

Figure 3:
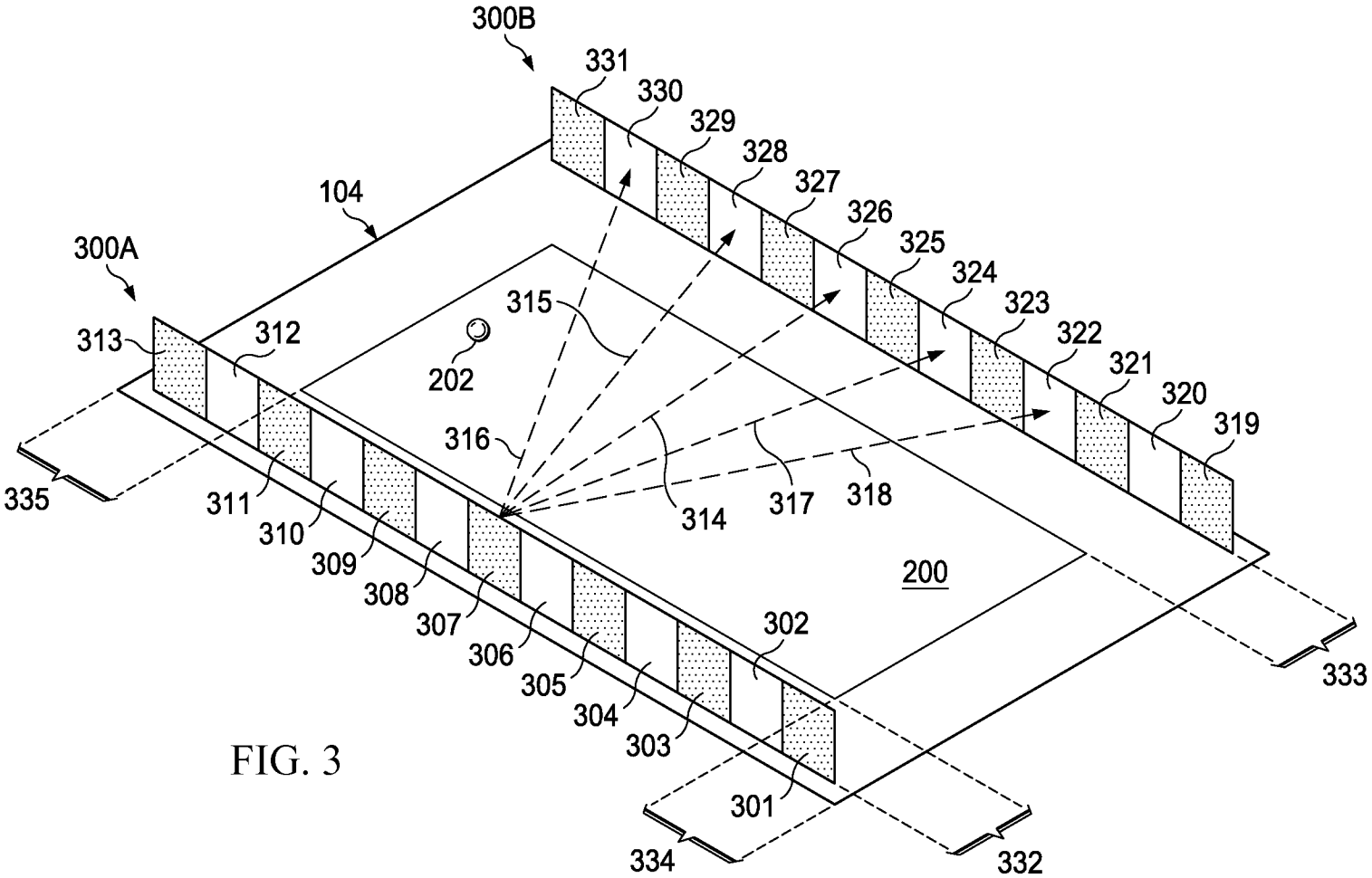
FIG. 3 is a three-dimensional, auxiliary view of an example of a tracking system in a hybrid playfield according to some embodiments.

Turning now to FIG. 3, a three-dimensional, auxiliary view of an example of tracking system 300 in hybrid playfield 104 is depicted according to some embodiments. As illustrated, tracking system 300 includes first IR transducer array 300A and second IR transducer array 300B. Arrays 300A and 300B are disposed immediately above the surface of playfield 104 on opposite sides of electronic display 200, and may be positioned such that other playfield components (e.g., trigger element 205, slingshots 206A and 206B, flippers 207A and 207B, etc.) do not interfere with its operations—that is, so that array 300A may have a least a partial direct line-of-sight with respect to array 300B. For instance, one or more of these playfield components may be "floating" with respect to electronic display 200 (e.g., attached or coupled to the top or cover of hybrid playfield 104).

In this example, arrays 300A and 300B are positioned at distances 332 and 333 from the sides of electronic display 200, and are longer than the height of electronic display 200 by lengths 334 and 335. In some implementations, distances and lengths 332-335 may be selected to avoid interfering with gameplay (i.e., without blocking ball 202's access to modular portion 201 or drain 208). Also, in cases where electronic display 200 extends to the edge of hybrid playfield 104, one or more of distances and lengths 332-335 may be zero and/or transducer arrays 300A and 300B may be positioned outside of hybrid playfield 104.

In this embodiment, IR transducer array 300A includes transmitter elements 301, 303, 305, 307, 309, 311, and 313 alternating with receiver or detector elements 302, 304, 306, 308, 310, and 312. Second IR transducer array 300B includes transmitter elements 319, 321, 323, 325, 327, 329, and 331 alternating with receiver or detector elements 320, 322, 324, 326, 328, and 330. It should be noted, however, that this particular configuration is provided for ease of explanation only, and that many other suitable configurations with a different number of arrays, transmitter elements, and detector elements may be used, sometimes in the same pinball machine 100. For instance, in other embodiments, tracking system 300 may include RF triangulation systems, video based motion tracking systems, capacitive systems, or other electro-mechanical position detection systems.

Figure 7:
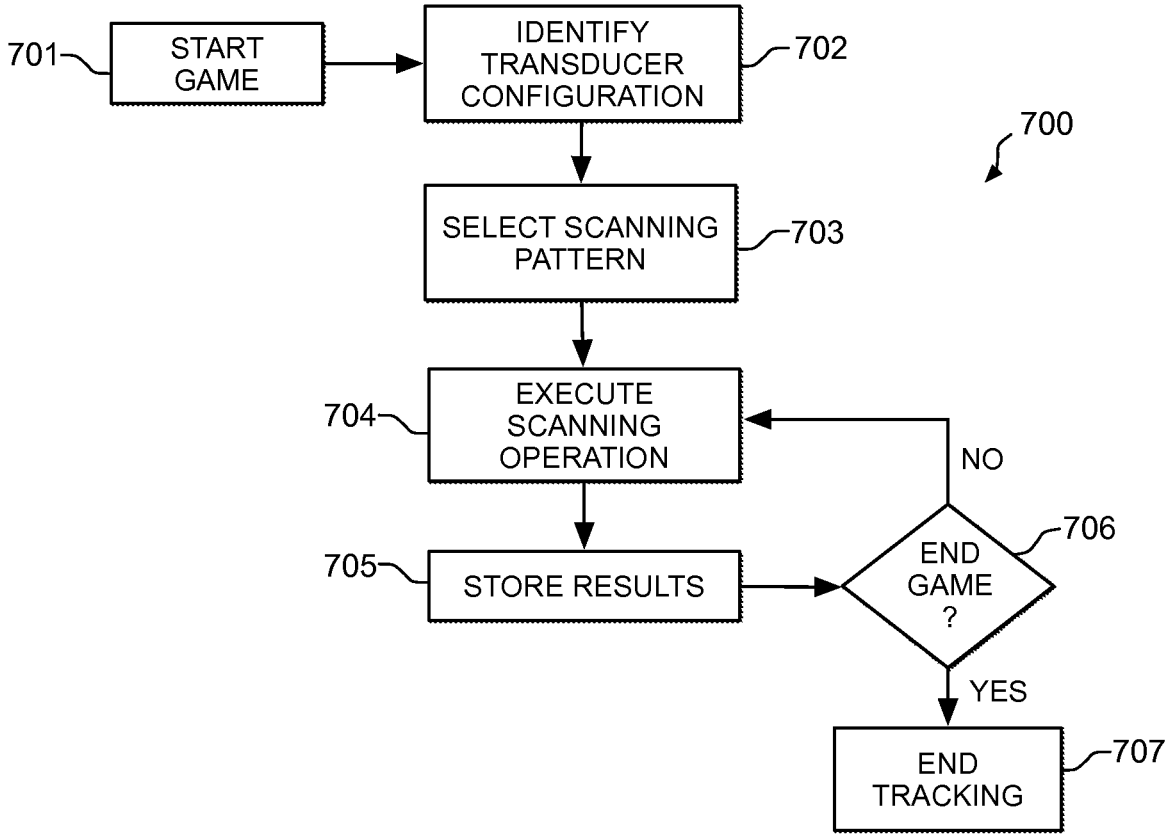
FIG. 7 is a flowchart of an example of a method of operating a tracking system in a hybrid playfield according to some embodiments.
Figure 8:
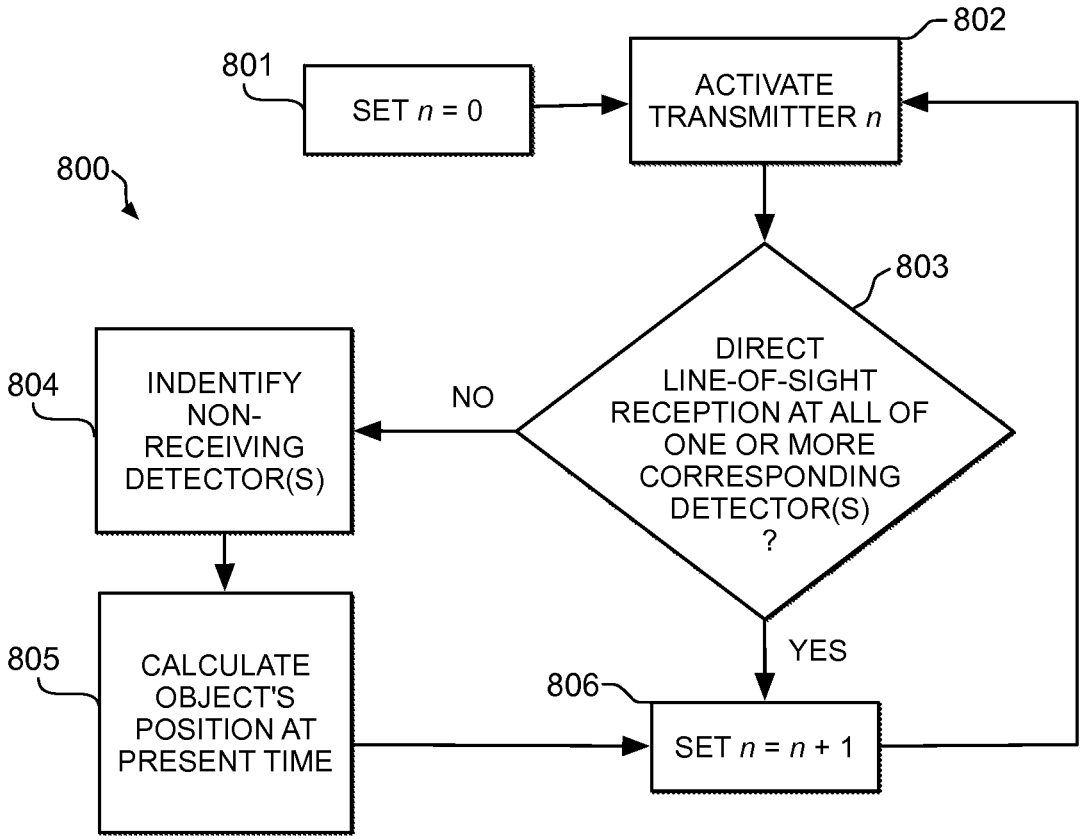
FIG. 8 is a flowchart of an example of a method of obtaining an object's position in a hybrid playfield using a tracking system according to some embodiments.

Tracking system 300 may be configured to scan hybrid playfield 104, for example, as explained in FIGS. 7 and 8. Briefly, each of transmitter elements 301, 303, 305, 307, 309, 311, and 313 of first array 300A may transmit IR signals in succession such that one or more of detector elements 320, 322, 324, 326, 328, and/or 330 of second array 300B receives these signals. Then, each of transmitter elements 319, 321, 323, 325, 327, 329, and 331 of second array 300B may transmit IR signals in succession such that one or more of detector elements 302, 304, 306, 308, 310, and/or 312 of first array 300A receives those signals. By determining which of detector elements 302, 304, 306, 308, 310, 312 320, 322, 324, 326, 328, and/or 330 were expected to receive their respective signals but did not, for example, because ball 202 was blocking that detector's line-of-sight, tracking system 300 may determine the position of ball 202 as it moves across hybrid playfield 104.

In some embodiments, tracking system 300 may be configured to determine the position, speed, and/or direction of movement of a physical object over hybrid playfield 104 with a margin of error no larger than the size of the physical object itself. Tracking system 300 may also be configured to determine the identification of a particular physical object, for example, when two balls 202 occupy hybrid playfield 104 simultaneously (e.g., via a chip or tag included in each ball 202, by maintaining a record of which ball gets deployed at what time and their respective trajectories, etc.). In some implementations, two or more tracking systems 300 may be used in the same hybrid playfield 104, and each of the two or more tracking systems 300 may be of a different type (e.g., an IR system and an RFID system, etc.).

Figure 4:
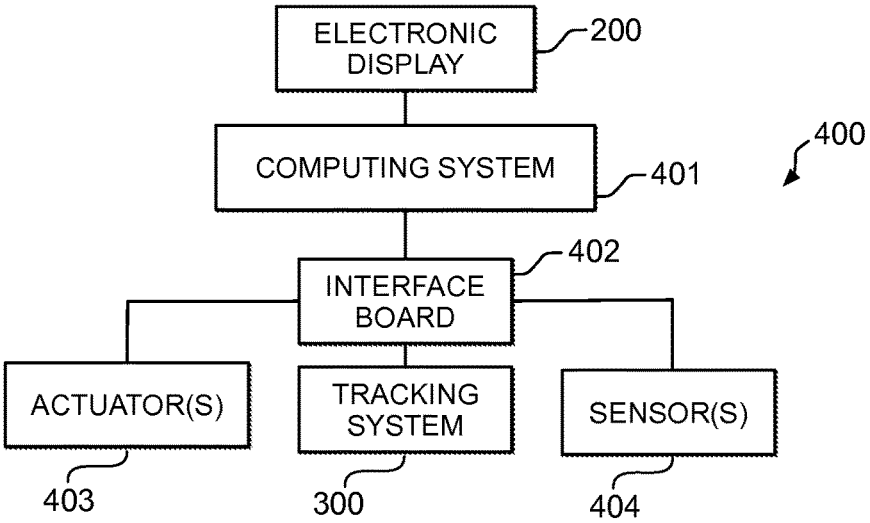
FIG. 4 is a block diagram of an example of hardware elements of a pinball machine with a hybrid playfield according to some embodiments.

FIG. 4 is a block diagram of an example of hardware elements 400 in pinball machine 100 with hybrid playfield 104 according to some embodiments. As shown, computing system or controller 401 is coupled to electronic display 200 of FIG. 2. Computing system 401 is also coupled to (or otherwise includes) interface board 402, which in turn is coupled to tracking system 300, actuator(s) 403, and/or sensor(s) 404.

In operation, computing system 401 may be configured to control electronic display 200 by providing one or more video signals capable of being rendered by electronic display 200 to create one or more 2D or 3D virtual objects in hybrid playfield 104 during a pinball game. Also, through interface board 402, computing system 401 may be configured to control the behavior of and/or to receive information related to physical objects in hybrid playfield 104 through interface board 402.

In some embodiments, interface board 402 may be any suitable pinball controller device such as, for example, the "Pinball—Remote Operations Controller" or "P-ROC" controller available from Multimorphic, Inc., which enables a computer to control a pinball machine over Universal Serial Bus (USB). It should be noted, however, that other pinball controller devices may be used as interface board 402, and that such a device may communicate with computing device 401 using any suitable bus and/or communication protocol.

In some cases, interface board 402 may be configured to control actuator(s) 403, such as, for example, coils, motors, etc. to thereby affect the behavior or status of physical elements, such as, for example, ball 202, barrier element 203, pipe element 204, trigger element 205, slingshots 206A and 206B, flippers 207A and 207B, or the like. Moreover, interface board 402 may be configured to receive information from sensor(s) 404 such as, for example, switches, optical sensors, etc., to determine the status of those physical objects. With regard to certain physical objects, such as, for example, ball 202, interface board 402 may also be configured to control tracking system 300 to obtain position and other information about those elements.

Figure 5:
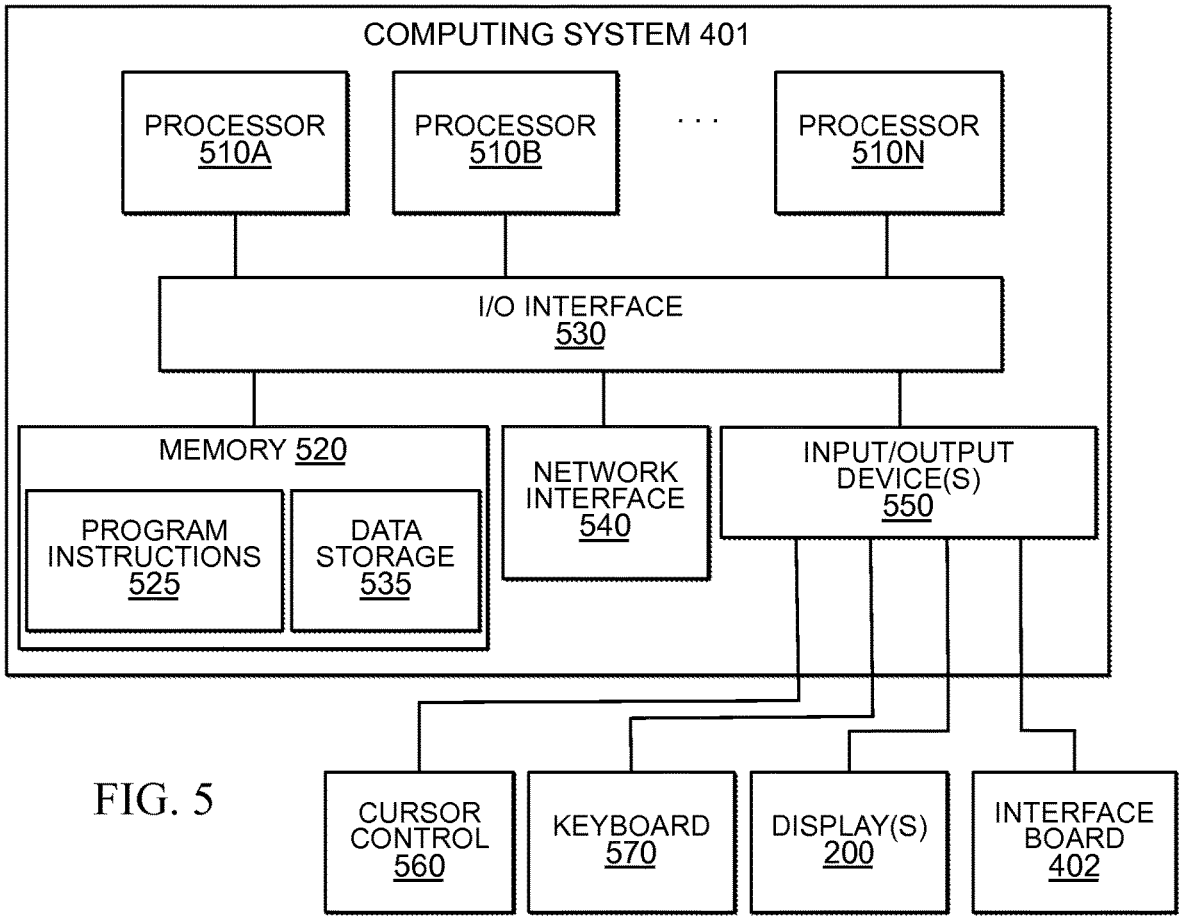
FIG. 5 is a block diagram of an example of a computing system or controller configured to implement aspects of a pinball machine with a hybrid playfield according to some embodiments.

FIG. 5 is a block diagram of an example of computing system 401 configured to implement aspects of pinball machine 100 with a hybrid playfield 104. In some embodiments, computing system 401 may be a server, a mainframe computer system, a workstation, a network computer, a desktop computer, a laptop, or the like. In other embodiments, one or more of the components described in connection with computing system 401 may be provided as a System-On-Chip (SoC), Application Specific Integrated Circuit (ASIC), or the like. More generally, however, computing system 401 may be any system, device, or circuitry capable of implementing or executing one or more of the various operations described herein.

In some implementations, computer system 401 may include one or more processors 510A-N coupled to a system memory 520 via an input/output (I/O) interface 530. Computing system 401 may further include a network interface 540 coupled to I/O interface 530, and one or more input/output devices 550, such as cursor control device 560, keyboard 570, electronic display(s) 200, and interface board 402.

In various embodiments, computing system 401 may be a single-processor system including one processor 510A, or a multi-processor system including two or more processors 510A-N (e.g., two, four, eight, or another suitable number). Processor(s) 510A-N may be any processor capable of executing program instructions. For example, in various embodiments, processor(s) 510A-N may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processor(s) 510A-N may commonly, but not necessarily, implement the same ISA. Also, in some embodiments, at least one processor(s) 510A-N may be a graphics processing unit (GPU) or other dedicated graphics-rendering device.

System memory 520 may be configured to store program instructions and/or data accessible by processor(s) 510A-N. In various embodiments, system memory 520 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described herein, may be stored within system memory 520 as program instructions 525 and data storage 535, respectively. In other embodiments, program instructions and/or data may be received, sent or stored upon different types of computer-accessible media or on similar media separate from system memory 520 or computing system 401. Generally speaking, a computer-accessible medium may include any tangible, non-transitory storage media or memory media such as magnetic or optical media—e.g., disk or CD/DVD-ROM coupled to computing system 401 via I/O interface 530.

The terms "tangible" and "non-transitory," are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor(s) 510A-N). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor(s) 510A-N.

Network interface 540 may be configured to allow data to be exchanged between computing system 401 and other devices attached to a network, such as other computer systems, or between nodes of computing system 401. In various embodiments, network interface 540 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

Input/output devices 550 may, in some embodiments, include one or more display terminals, keyboards, keypads, touch screens, scanning devices, voice or optical recognition devices, or any other devices suitable for entering or retrieving data by one or more computing system 401. Multiple input/output devices 550 may be present in computing system 401 or may be distributed on various nodes of computing system 401. In some embodiments, similar input/output devices may be separate from computing system 401 and may interact with one or more nodes of computing system 401 through a wired or wireless connection, such as over network interface 540.

As shown in FIG. 5, memory 520 may include program instructions 525, configured to implement certain embodiments described herein, and data storage 535, comprising various data accessible by program instructions 525. In an embodiment, program instructions 525 may include software elements of embodiments illustrated in FIG. 2. For example, program instructions 525 may be implemented in various embodiments using any desired programming language, scripting language, or combination of programming languages and/or scripting languages (e.g., C, C++, C#, JAVA®, JAVASCRIPT®, PERL®, etc.). Data storage 535 may include data that may be used in these embodiments. In other embodiments, other or different software elements and data may be included.

A person of ordinary skill in the art will appreciate that computing system 401 is merely illustrative and is not intended to limit the scope of the disclosure described herein. In particular, the computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be performed and/or other additional operations may be available. Accordingly, systems and methods described herein may be implemented or executed with other configurations.

Figure 6:
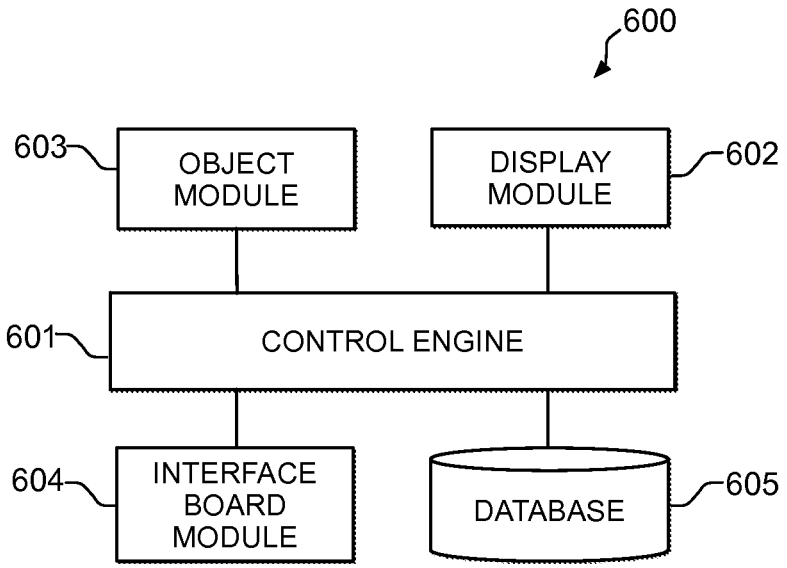
FIG. 6 is a block diagram of an example of a software program configured to implement aspects of a pinball machine with a hybrid playfield according to some embodiments.

FIG. 6 is a block diagram of an example of software program 600 configured to implement aspects of pinball machine 100 with a hybrid playfield 104. In some embodiments software 600 may be executed by computing system 401 described above. For example, in some cases, software program 600 may be implemented as program instructions 525 of FIG. 5. Generally speaking, control engine 601 may include one or more routines configured to implement one or more of the various techniques described herein. For instance, control engine 601 may include one or more routines configured to allow a user to select a game stored in database 605. Control engine 601 may also include one or more routines configured to allow a user to start or terminate a game, as well as one or more routines configured to manage progress of a game.

Display module 602 may provide a software interface between computing device 401 and electronic display 200 such that images produced by display module 602 are rendered in electronic display 200 under control of control engine 601. Interface board module 604 may provide a software interface between computing device 401 and interface board 402. Through interface board module 602, control engine 601 may determine that one or more sensor(s) 404 have been activated and/or it may control, via actuator(s) 403, a physical aspect of a physical object in hybrid playfield 104. Control engine 601 may also receive tracking information from tracking system 300 via interface board module 602.

Object module 603 may keep track of one or more graphical elements or virtual objects being displayed (or yet to be displayed) on electronic display 200 via display module 602, including, for example, a virtual object's characteristics such as the object's identification, boundaries, shape, color, size, texture, position (on electronic display 200), speed, direction of movement, etc. Object module 603 may also keep a record of the received tracking information for one or more physical objects including, for example, an identification of the physical object, its position (above electronic display 200), speed, direction of movement, shape, etc.

In some embodiments, the modules or blocks shown in FIG. 6 may represent processing circuitry and/or sets of software routines, logic functions, and/or data structures that, when executed by the processing circuitry, perform specified operations. Although these modules are shown as distinct logical blocks, in other embodiments at least some of the operations performed by these modules may be combined into fewer blocks. For example, in some cases, object module 603 may be combined with display module 602 and/or with interface board module 604. Conversely, any given one of modules 601-605 may be implemented such that its operations are divided among two or more logical blocks. Although shown with a particular configuration, in other embodiments these various modules or blocks may be rearranged in other suitable ways.

FIG. 7 is a flowchart of an example of method 700 of operating tracking system 300 in hybrid playfield 104. In some embodiments, method 700 may be performed, at least in part, by computing system 401 executing software 600 in cooperation with interface board 402 and tracking system 300. At block 701, method 700 may include determining that a pinball game has started or is about to start. At block 702, method 700 may include identifying a transducer configuration to be used by tracking system 300. As previously noted, different transducer configurations may be used in a single machine 100, and, depending upon the specific game being played, a particular configuration may be more suitable for tracking certain physical objects.

At block 703, method 700 may include selecting a scanning pattern to be used during a tracking operation. For example, in the configuration shown in FIG. 3, the selected scanning pattern assigns detector elements 322, 324, 326, 328, and 330 to receive signals 318, 317, 314, 315, and 316 emitted by transmitter element 307, respectively. In some cases, a scanning pattern may be such that each of transmitter elements 301, 303, 305, 307, 309, 311, 313, 319, 321, 323, 325, 327, 329, and 331 is activated in rapid succession and in this order. In other cases, a transmitter element of first transducer array 300A may be activated followed by a transmitter element of second transducer array 300B in an alternating manner (e.g., 301, 319, 303, 321, and so on). In yet other cases, two or more transmitter elements may be activated simultaneously.

In some implementations, more or fewer detectors may be assigned to receive more or fewer signals from a given transmitter element at a given time. Moreover, the position of the transmitter element may dictate how many and which detector elements are assigned for a given scanning pattern. For instance, using the pattern illustrated in FIG. 3, when transmitter 301 is active, only detectors 320 and 322 (i.e., two detectors) may be configured to receive its signals. When transmitter 303 is active, detectors 320, 322, 324, and 326 (i.e., four detectors) may be configured to receive its signals. And, when transmitter 305 is active, detectors 320, 322, 324, 326, and 328 (i.e., five detectors) may be configured to receive its signals. In other implementations, however, a 1:1 relationship between transducer elements may be established such that a given detector is assigned to a single corresponding transmitter and vice-versa.

More generally, any suitable scanning pattern may be selected that creates a mesh such that, when a physical object such as ball 202 is traveling between transducer arrays 300A and 300B therefore blocking the line-of-sight between a transmitter and an assigned detector, tracking system 300 and/or computing system 401 is capable of determining the position, speed, and/or direction of movement of the physical object. In various embodiments, signals are transmitted and received between transducer arrays 300A and 300B at angles other than a right angle.

At block 704, method 700 may execute scanning operation(s) using the identified configuration and/or selected pattern and, at block 705, method 700 may store results of those operation(s). At block 706, method 700 may determine whether the game has ended. If not, control returns to block 704. Otherwise, tracking may end at block 707.

It should be noted that, in some embodiments, one or more of the operations described above may be conducted independently of whether a game is in progress. For example, in some cases, tracking may be active for purposes of touchscreen interactions when pinball machine 100 is in "service mode" (e.g., testing, debugging, etc.). More generally, electronic display 200 in conjunction with tracking system 300 may allow an operator to interface with aspects of computing system 401 at any time, for instance, to change the machine's configuration, select a new pinball game, test one or more of the machine's components, etc.

FIG. 8 is a flowchart of an example of method 800 of obtaining an object's position in hybrid playfield 104 using tracking system 300 according to some embodiments. Again, in some embodiments, method 800 may be performed, at least in part, by computing system 401 executing software 600 in cooperation with interface board 402 and tracking system 300. At block 801, method 800 may include initializing or setting an integer or counter n to a zero value and, at block 802, method 800 may include activating transmitter element n.

At block 803, method 800 may include determining whether there is a direct line-of-sight reception at all of the one or more assigned detector elements. If so, then block 806 increments the value of n and control returns to block 802, where a subsequent transmitter element following the selected scanning pattern is selected. Otherwise, at block 804, method 800 may include identifying which of the assigned detector elements had its light-of-sight blocked by a physical object. Then, at block 805, method 800 may include calculating the physical object's position based, at least in part, upon the result of block 804.

To illustrate operations 802-806, consider the following example. Assume, hypothetically, that ball 202 shown in FIG. 3 is now at a position such that it blocks the light-of-sight of detector 330 when transmitter 307 is activated. Because the relative position between arrays 300A and 300B is known, it may be inferred that, at the time of the scan, ball 202 was located somewhere along the path of signal 316. As n is incremented, subsequent transmitter elements are activated and other detectors may have their light-of-sight blocked, such that the position of ball 202 may be determined to be at the intersection(s) of two or more of these signals.

In some embodiments, the frequency of the scanning operation may be such that a sufficient number of transmitters are activated in series to resolve the position of ball 202 prior to ball 202 having moved to another position that is significantly distant from the resolved position. For example, in some cases, the position of ball 202 may be identified with a margin of error no larger than the diameter of ball 202.

Computing system 401, interface board 402, and/or object module 603 may also maintain a historical record of the positions of ball 202 at different times. Therefore, computing system 401 and/or interface board 402 may be configured to calculate a speed of ball 202 and/or a direction of movement of ball 202 based on that historical record. In some cases, computing system 401 and/or interface board 402 may be further configured to predict the position of ball 202 at a future time based upon its present and/or past behavior.

Physical Objects Causing Changes in Virtual Objects

In some embodiments, hybrid playfield 104 may provide the illusion that one or more physical objects, such as one or more balls 202, interact with one or more virtual objects, such as one or more images rendered on electronic display 200. This may take place, for example, when a physical object is detected via tracking system 300 to be moving over an area of hybrid playfield 104 containing the virtual objects. In other examples, the interaction with virtual objects may be triggered upon detection, via tracking system 300, that a physical object has a certain speed or moves in a particular direction (e.g., toward a virtual object) across hybrid playfield 104.

In some cases, interactions between a physical object and a first virtual object may cause that first virtual object to move, change its shape, disappear, etc. on electronic display 200. The same interactions between the physical object and the first virtual object may also cause a second virtual object to move, change its shape, appear, disappear, etc. on electronic display 200. Other game-related interactions resulting from the interaction of physical and virtual objects in hybrid playfield 104 may include, but are not limited to, game scores being adjusted, sound and video devices being played, lamps being turned on and off individually or in pre-defined sequences, etc.

Figure 9:
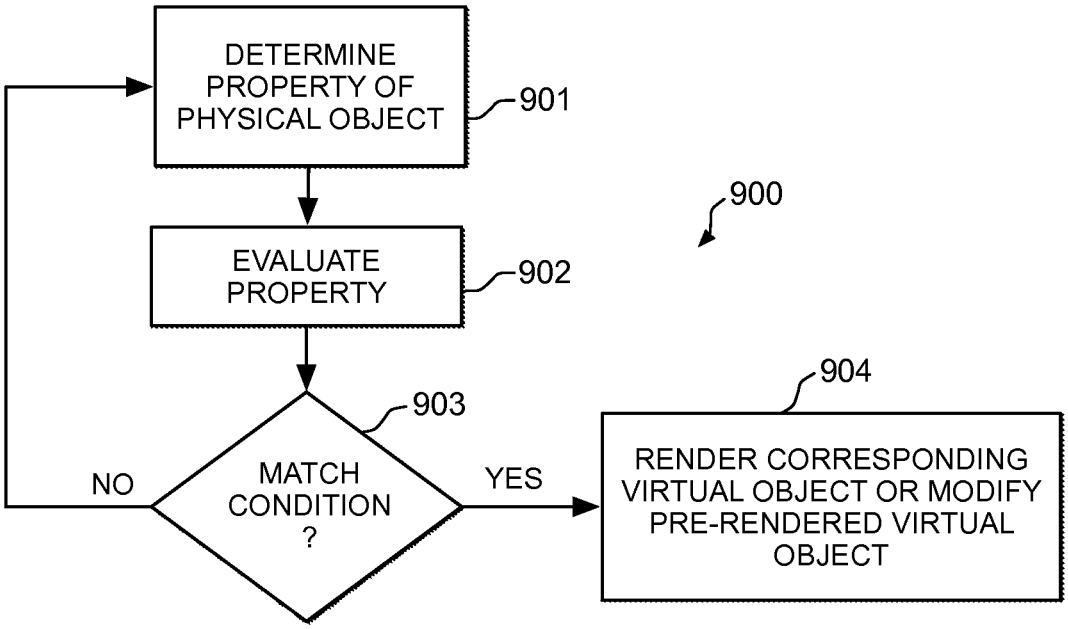
FIG. 9 is a flowchart of an example of a method of enabling physical object(s) to interact with virtual object(s) in a hybrid playfield according to some embodiments.

FIG. 9 is a flowchart of an example of a method of enabling physical object(s) to interact with virtual object(s) in hybrid playfield 104. In some embodiments, method 900 may be performed, at least in part, by computing system 401 executing software 600 in cooperation with electronic display 200, interface board 402, and tracking system 300. At block 901, method 900 may include determining a property of a physical object (e.g., ball 202). For instance, in some cases, method 900 may include determining a position of the physical object on hybrid playfield 104, a speed of the physical object over hybrid playfield 104, and/or a direction of movement of the physical object across hybrid playfield 104.

At block 902, method 900 may evaluate the property. At block 903, if the property does not match any preselected conditions, control returns to block 901. Otherwise, control passes to block 904, where method 900 may include rendering a corresponding virtual object on display 200 or modifying a previously rendered virtual object. The conditions referred to in block 903 may include any programmable statement(s) that, when executed, give the appearance that the physical object's property or behavior has affected one or more virtual objects.

In some implementations, a player may indirectly manipulate the physical object described in block 901. For example, when the physical object is ball 202, the player may briefly hit that object with another physical object, such as flippers 207A and 207B. Manipulation of flippers 207A and 207B may itself be indirect, for example, via side control(s) 107. After being hit, ball 202 may travel along playfield freely and outside of the user's control.

It should be noted that determination of a property of a physical object in block 901 is different from the detection of a player's own finger or stylus on a capacitive touchscreen of a tablet computer, which the user directly controls. For example, in the tablet scenario, if the touchscreen does not respond as expected by the user, the user may simply repeat his or her gesture; whereas in the case of a pinball machine, because ball 202 moves on its own, it would be much more difficult to make ball 202 repeat the exact same trajectory at a later time and, in any event, a game opportunity would be lost.

Figure 10A:
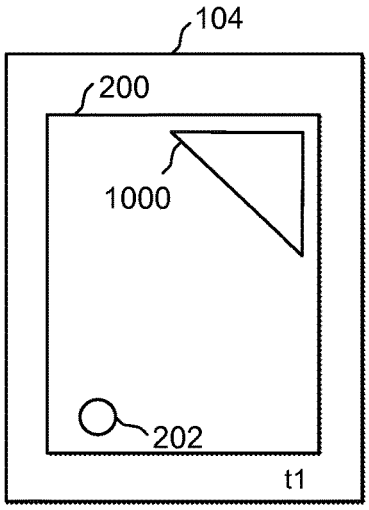
FIGS. 10A-H are diagrams illustrating examples of physical object(s) initiating interaction(s) with virtual object(s) according to some embodiments.
Figure 10B:
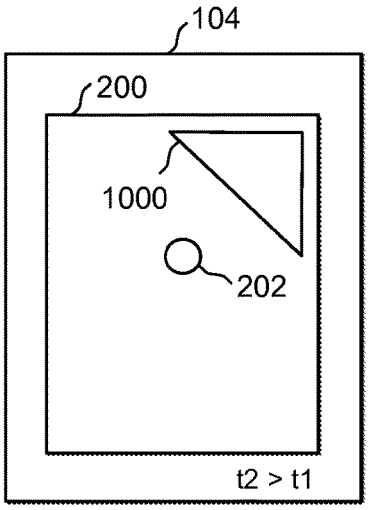
Figure 10C:
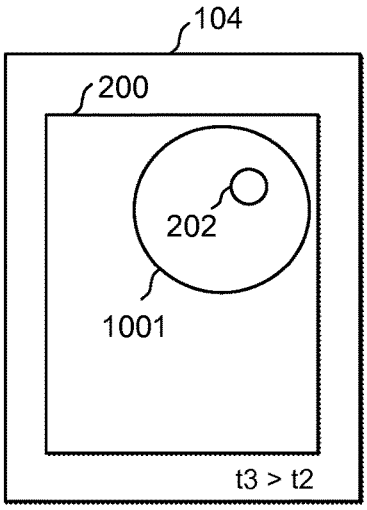

FIGS. 10A-H are diagrams illustrating examples of physical object(s) initiating interaction(s) with virtual object(s) according to some embodiments. Particularly, FIG. 10A shows ball 202 (i.e., a physical object) at t=t1 traveling along hybrid playfield 104 while electronic display 200 renders virtual object 1000 in the shape of a triangle. At FIG. 10B, ball 202 has moved closer to virtual object 1000 at t=t2 (t2>t1), but has not yet reached it. Then, at FIG. 10C, ball 202 has reached the position of virtual object 1000 on electronic display 200 at t=t3 (t3>t2), thus causing virtual element 1000 to change into virtual element 1001, which now has a circular shape. Referring back to FIG. 9, the predetermined condition expressed in block 903 in this case may be such as:

```
if position of <ball 202>==position of <virtual
    object 1000>;

then change <virtual object 1000> into <virtual
    object 1001>
```

Thus, in this case, the operations of method 900 may help create a visual impression that ball 202 has physically interacted with virtual object 1000 upon reaching its location in hybrid playfield 104 and effectively changed the virtual object's shape and/or other visual characteristic.

Figure 10D:
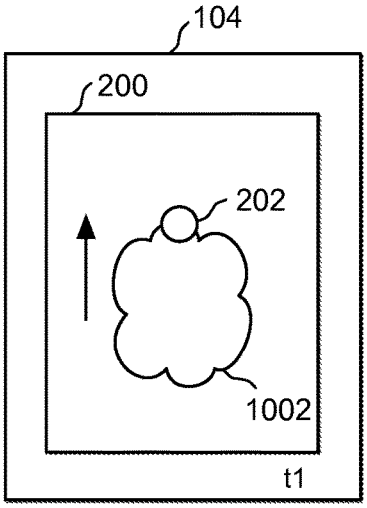
Figure 10E:
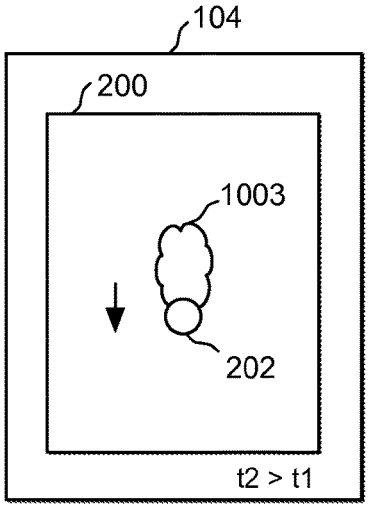

As another example, FIG. 10D illustrates ball 202 traveling upwards (shown by an arrow pointing up) across hybrid playfield 104 at t=t1 (e.g., after being hit by flipper(s) 207A or 207B), thus acquiring a first speed. FIG. 10E shows ball 202 traveling in a downwards direction (shown by an arrow pointing down) at t=t2 (t2>t1) with a second speed which, in this case, is smaller than the first speed. Accordingly, in FIG. 10D, virtual object 1002 represents a graphical image or visual animation of fire or smoke following ball 202 and having a first size proportional to the first speed, whereas in FIG. 10E virtual object 1003 represents the fire or smoke with a second size proportional to the second speed, such that the first size is larger than the second size.

Figure 10F:
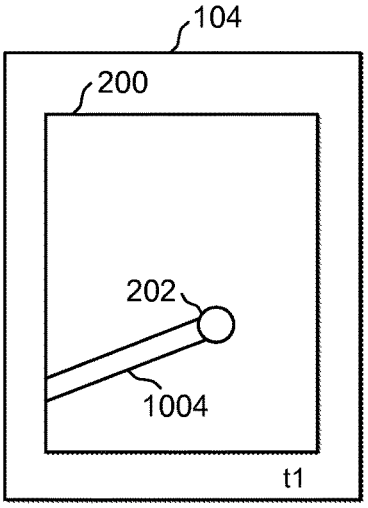
Figure 10G:
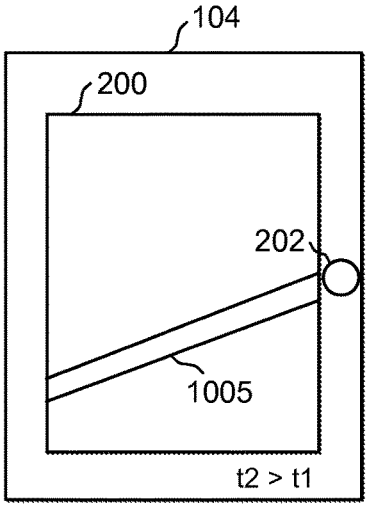
Figure 10H:
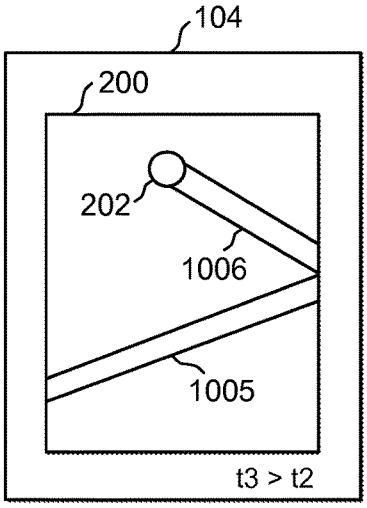

As yet another example, FIG. 10F shows ball 202 traveling across hybrid playfield 104 at t=t1 in a first direction thus leaving trail or mark 1004. FIG. 10G shows ball 202 leaving the surface of electronic display 200 and reaching the boundary of hybrid playfield 104 at t=t2 (t2>t1), from which ball 202 bounces back. As such, trail or mark 1005 is longer than trail or mark 1004. Then, FIG. 10H shows ball 202 traveling across hybrid playfield 104 in a second direction at t=t3 (t3>t2), thus creating trail or 1006 in the second direction.

It should be noted that the examples of FIGS. 10A-H are provided for sake of illustration. More generally, any virtual object(s) rendered on electronic display 200 may be affected by any physical property (or combination of physical properties) of any physical object(s) within hybrid playfield 104 in any suitable manner. In the examples above, the physical properties used are position, speed, and direction; although in other embodiments, other physical properties may be used such as shape, size, sound, color, etc. In various implementations, the type of virtual object and how that object is affected by the behavior of a physical object normally depends upon the specific game being played, and as such may vary from game to game.

Moreover, in some embodiments, the behavior of a physical object may be detected other than through tracking system 300. For instance, ball 202 may physically reach trigger element 205, and electronic display 200 may in response render an animation such that it appears that a first virtual object such as an image of a laser beam or projectile is shot by trigger element 205 into hybrid playfield 104. The first virtual object may then interact with other virtual objects on electronic display 200; for example, the virtual laser beam or projectile may cause a second virtual object (e.g., an image of a building, etc.) to explode on electronic display 200.

Virtual Objects Causing Changes in Physical Objects

In some embodiments, hybrid playfield 104 may present the illusion that one or more virtual objects, such as one or more images rendered on electronic display 200, interact with one or more physical objects, for example, when the virtual object exhibits a predetermined behavior. For instance, when a virtual element is animated on display 200 in a particular way, it may trigger a software-initiated modification to an aspect of a physical object.

Figure 11:
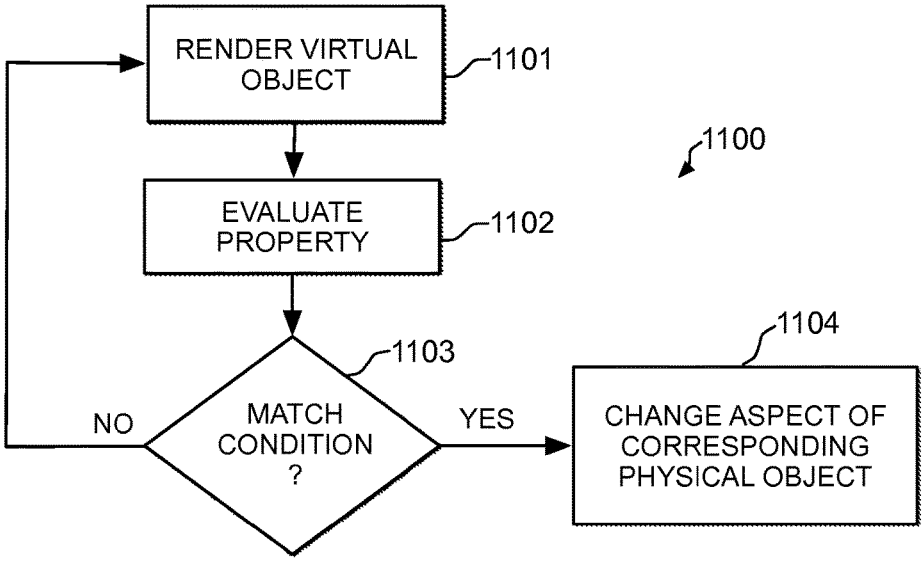
FIG. 11 is a flowchart of an example of a method of enabling virtual object(s) to interact with physical object(s) in a hybrid playfield according to some embodiments.

In that regard, FIG. 11 is a flowchart of an example of a method of enabling virtual object(s) to interact with physical object(s) in hybrid playfield 104. In some implementations, method 1100 may be performed, at least in part, by computing system 401 executing software 600 in cooperation with electronic display 200, interface board 402, and tracking system 300. At block 1101, method 1100 may include rendering a virtual object on electronic display 200. At block 1102, method 1100 may include evaluating a property of the virtual object. At block 1103, if the property does not match a programmed condition, control returns to block 1101. Otherwise, at block 1104, method 1100 may include changing an aspect of a corresponding physical object.

Figure 12A:
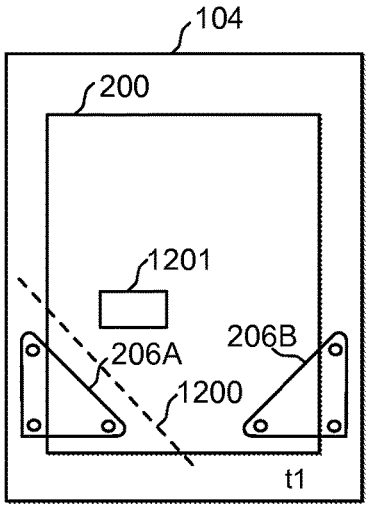
FIGS. 12A-F are diagrams illustrating examples of virtual object(s) initiating interaction(s) with physical object(s) according to some embodiments.
Figure 12B:
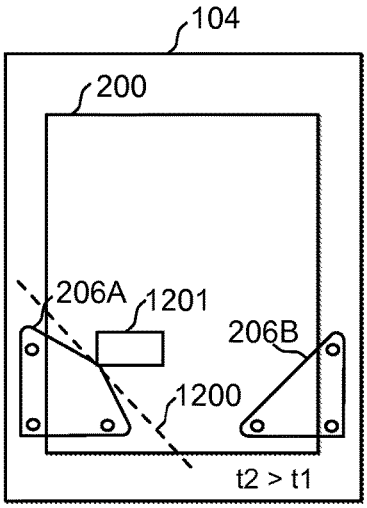
Figure 12C:
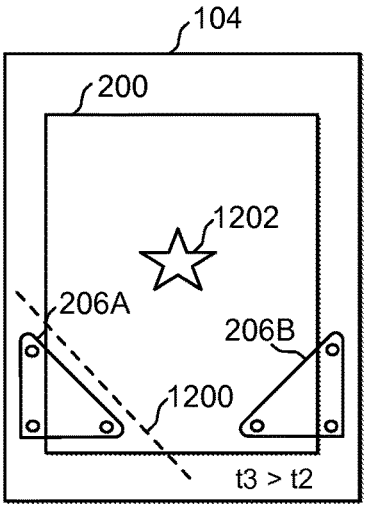

FIGS. 12A-F are diagrams illustrating examples of virtual object(s) initiating interaction(s) with physical object(s) according to some embodiments. In FIG. 12A, virtual object 1201 is animated on display 200 to move at t=t1 toward slingshot 206A, a physical object. FIG. 12B shows virtual object 1201 reaching threshold line 1200 at t=t2 (t2>t1), thus triggering a deformation of slingshot 206A such that, to an observer, it appears as if slingshot 206A is reacting physically to the behavior of virtual object 1201 on display 200. The deformation of slingshot 206A is a physical response initiated by software because, in this case, virtual object 1201 is in a specific position relative to slingshot 206A. In an embodiment, the shape of slingshot 206A may be controlled by a solenoid mechanism that, when activated by software, pushes against a side of slingshot 206A, thus causing it to mechanically expand. Then, FIG. 12C shows slingshot 206A returning to its original shape at t=t3 (t3>t2), and electronic display 200 changes the shape of virtual element 1201 into virtual element 1202, which now travels away from slingshot 206A on display 200 as if it had physically bounced off of slingshot 206A and now appears to be moving further away from slingshot 206A.

By drawing virtual element 1202 such that it appears to be moving away from slingshot 206A, this technique may cause observer, such as the player, to believe that a virtual element 1201 (i.e., a graphical image) actually represents a physical object that interacted mechanically or physically with another (but actual) physical object (i.e., slingshot 206A). More specifically, it may appear as if virtual element 1201 actually collided with slingshot 206A, causing a solenoid mechanism to activate, in turn causing slingshot 206A to "push" virtual element 1202 away from it.

Figure 12D:
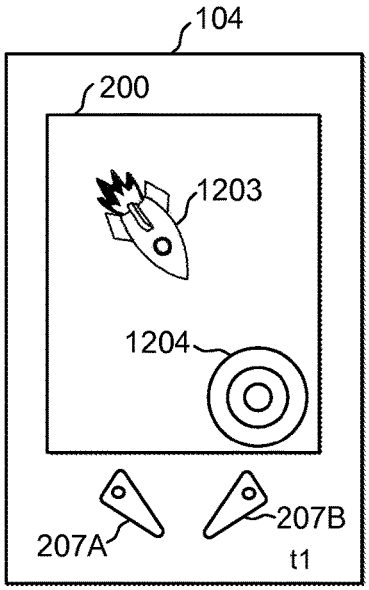
Figure 12E:
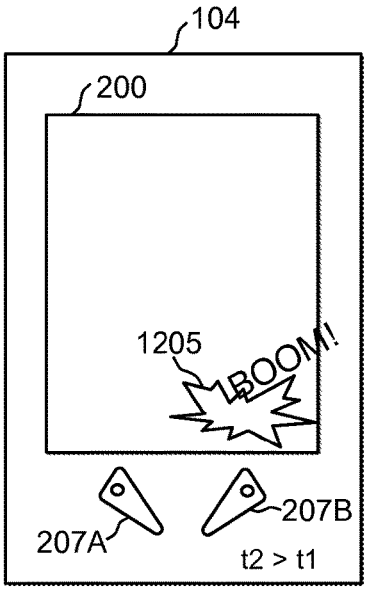
Figure 12F:
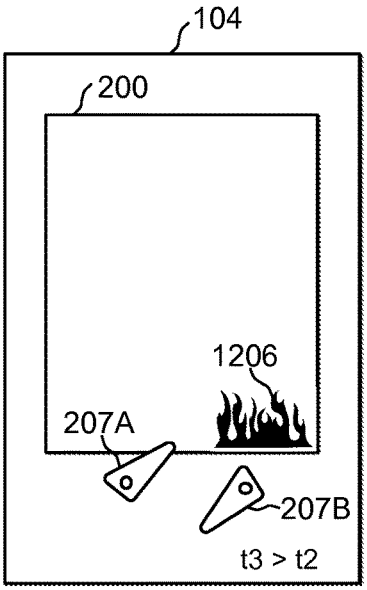

In other embodiments, a virtual element does not need to appear to come into contact with a physical object, but it may still affect the operation of that physical object. An example of this technique is shown in FIGS. 12D-E. In FIG. 12D, a first virtual object 1203 (a rendering of a missile) is animated to move toward a second virtual element 1204 (a rendering of a target) on electronic display 200 at t=t1. FIG. 12E shows that first virtual object 1203 and second virtual object 1204 have been replaced by third virtual object 1205 (a rendering of an explosion) upon first virtual object 1203's reaching of second virtual object 1204 at t=t2 (t2>t1). At this moment, operation of flipper 207B (i.e., a physical object) may be changed such that, when a player activates side control(s) 107, only flipper 207A is capable of moving upwards while flipper 207B is stuck in a down position as a result of the collision between virtual element 1203 and virtual element 1204. In some cases, a fourth virtual object 1206 (e.g., a rendering of fire or smoke) may indicate that flipper 207B is not operational such that, when virtual object 1206 disappears of fades from electronic display 200, flipper 207B returns to its normal operation under control of the player.

In other words, when the first virtual object reaches a specific point on electronic display 200, it may cause a specific, predetermined reaction in a physical object, such as one or more flippers 207A and 207B. An example of such a reaction may be to cause the one or more of flippers 207A and 207B to flip, as if the missile pressed a "virtual flipper" button. Another reaction may be causing flippers 207A and 207B to "lose power," such that when the player next activates the flippers, they do not have as strong a pulse as they did prior to the missile reaching the specific location on electronic display 200. Because the length of the flipper pulse, and therefore the power of the pulse, is controlled by software, control engine 601 may effectively weaken flippers 207A and/or 207B in response to missile 1203 reaching the specific location on the electronic display 200. This technique may make it appear that the graphical, virtual object (i.e., missile 1203) represented a physical element, such as a real missile, and was therefore capable of affecting physical object (i.e., flippers 207A and 207B).

Similarly as explained above, here it should also be noted that the examples of FIGS. 12A-F are provided for sake of illustration. More generally, any physical object(s) in hybrid playfield 104 may have its propert(ies) modified in response to the behavior of one or more virtual object(s). Properties of the physical objects that may be subject to being changed include its shape, operation, color, sound, etc. Again, in various implementations, the type of physical object and how that object is affected by the behavior of a virtual object normally depends upon the specific game being played, and as such may vary from game to game.

Physical objects that can be affected by virtual objects include, but are not limited to, lamps, light emitting diodes (LEDs), magnets, motors, and solenoid assemblies, all of which may be found on pinball machine 100. Virtual objects that may interact with physical objects include, but are not limited to, shapes or combination of shapes drawn on a display element, projected from a projection device, or otherwise displayed in a way that they appear to be part of or on pinball machine 100. The location of virtual objects can be anywhere on machine 100, oftentimes, but not always, close to the physical objects with which they appear to interact. In the example above where the missile is described to press a virtual flipper button, the spatial proximity of the missile and virtual button relative to the flippers is not relevant. As such, the graphical elements (missile and virtual button) can be located anywhere on electronic display 200.

Deploying Physical Objects

In some embodiments, one or more of the aforementioned physical objects such as, for example, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc., or other physical objects, may be located in pinball machine 100. At least in part due to the presence of electronic display 200, tracking system 300, and/or other components, one or more of these physical objects may be deployed within hybrid playfield 104 as described in more detail below.

There are many places in a pinball machine where the systems and methods described herein may be used. Common situations involve places where there is not enough room for all of the components required to strike and apply an acceleration to other objects. In such cases, the components may be separated into connected components, one or more components being remotely located with respect to another component(s), two or more components connected to each other or linked in a suitable manner.

Figure 13:
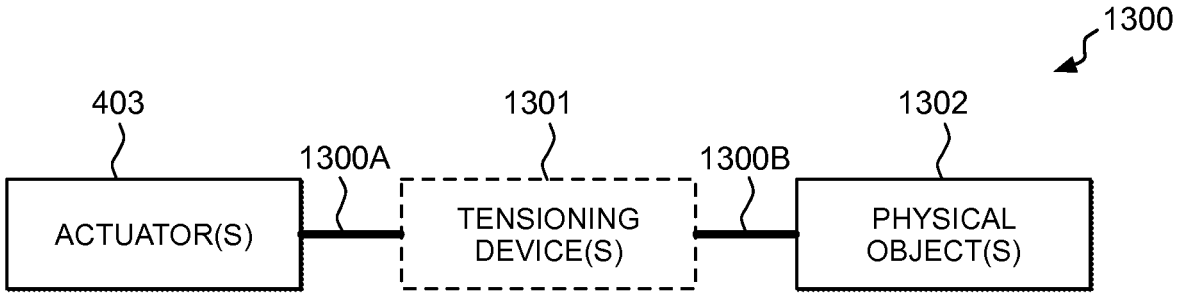
FIG. 13 is a block diagram of an example of a remote actuator system according to some embodiments.

In that regard, FIG. 13 is a block diagram of an example of a remote actuator system according to some embodiments. As illustrated, one or more actuator(s) 403 are operably coupled to one or more physical object(s) 1302 via one or more links. Particularly, in this example, link portion 1300A couples actuator(s) 403 to tensioning device(s) 1301, and link portion 1300B couples tensioning device(s) 1301 to physical object(s) 1302. It should be noted, however, that link portions 1300A and 1300B may in fact constitute a single, continuous link (collectively referred to as "link") and that, in some cases, tensioning device(s) 1301 may be absent. Tensioning device(s) 1301, when present, may be located somewhere along the link.

Generally speaking, movement of actuator(s) 403 creates a force applied to physical object(s) 1302 via the link. Particularly, link portions 1300A and 1300B coupled between actuator(s) 403 and physical object(s) 1302 ensure that the movement of actuator(s) 403, or component(s) within actuator(s) 403, is translated into the movement of physical object(s) 1302.

In some implementations, actuator(s) 403 may include an electric motor, plunger, or the like having a coil or solenoid element. When actuator(s) 403 (or one or more components within actuator(s) 403) moves, link portions 1300A and 1300B also move. The movement of link portions 1300A and 1300B cause physical object(s) 1302 to move as well. In some implementations, the specific nature of the movement of actuator(s) 403 and physical object(s) 1302 may be to cause physical object(s) 1302 to strike and apply an accelerating force to another physical object (e.g., ball 202) in the pinball machine.

In some embodiments, tensioning device 1301 may be used to adjust the position and/or movement of physical object(s) 1302. For example, tensioning device may include a knob and a bracket or mount such that the link goes through both the knob and the bracket or mount. The bracket or mount may be coupled to a portion of the pinball machine to keep the knob from moving when a force is applied by actuator(s) 403 to the link, whereas the knob may increase the tension on the link when turned in one direction, and it may decrease the tension on the link when turned in the other direction. In other implementations, tensioning device 1301 may include a turnbuckle, a ratcheting device, or another suitable tensioning mechanism.

Link portions 1300A and 1300B may be used to translate the movement of actuator(s) 403, or component(s) of actuator(s) 403, into the movement of physical object(s) 1302 and may be made of any suitable material that is easy to bend and reshape, for example, at room temperature. The shapes of link portions 1300A and 1300B may also be dynamically adjusted when a force is applied to it by the movement of actuator(s) 403.

In some implementations, the material used for link portions 1300A and/or 1300B may include a flexible material that is readily capable of assuming various curved or bent configurations or paths within hybrid playfield 104, such as wire, rope, malleable steel cable, etc. For instance, link portions 1300A and 1300B may assume different configurations (e.g., bend around different points along their lengths) during the course of a pinball game as actuator(s) 403 and/or physical object(s) 1302 are operated. In other implementations, the material used for link portions 1300A and/or 1300B may include a rigid material such as a steel rod, metal bar or arm, hard plastic (e.g., thermosetting plastics, etc.), or the like.

The lengths of link portions 1300A and 1300B may be determined by the positions at which actuator(s) 403 and physical object(s) 1302 are placed, as well as the path that the link needs to take to connect to actuator(s) 403 and physical object(s) 1302. For instance, when actuator(s) 403 are located in close proximity to physical object(s) 1302, the link may be short. Conversely, when actuator(s) 403 are located far away from physical object(s) 1302, the link may be long. As such, through the use of link portions 1300A and 1300B, actuator(s) 403 and physical object(s) 1302 may be located anywhere in the pinball machine, even large distances apart from each other.

In some embodiments, a housing or pipe may be used to provide a more rigid and consistent guide for the link's movement. Such housing may be a hollow tube or other material through which link portions 1300A and/or 1300B is routed. Further, the housing may be mounted in a way that it does not move relative to the pinball machine when actuator(s) 403 (and therefore the link) moves. Rather, link portions 1300A and/or 1300B move through it. Therefore, in some implementations, a cable housing may provide a well-defined and unchanging path that the link may follow when translating the movement of actuator(s) 403 to the movement of physical object(s) 1302.

Figure 14:
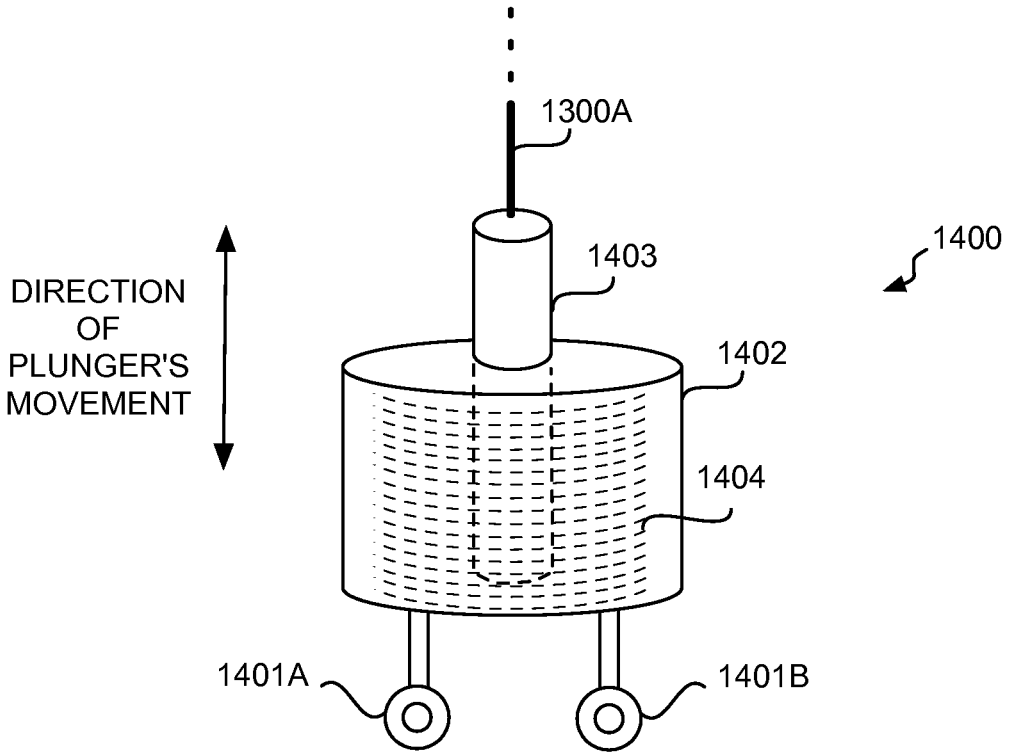
FIG. 14 is a three-dimensional diagram of an example of a single actuator according to some embodiments.

FIG. 14 shows a diagram of an example of a single actuator 1400. In some embodiments, single actuator 1400 may be used as actuator(s) 403 in FIG. 13. In this illustration, single actuator 1400 includes one or more components that may be made to move in order to exert a force on link portions 1300A and/or 1300B. Particularly, casing 1402 includes electromagnet solenoid 1404 made up of a wire coupled to terminal 1401A, the solenoid being wrapped dozens or hundreds of times around a hollow core, and then coupled to another terminal 1401B. When a predetermined voltage is applied across terminals 1401A and 1401B, electrical current flows through solenoid 1404, thus creating a magnetic field inside the core around which the wire is wrapped. When the magnetic field is active, metal plunger 1403 is pulled into casing 1402 (a "first direction").

Link portion 1300A is coupled to plunger 1403 such that, when plunger 1403 is pulled in the first direction, link portions 1300A and/or 1300B are pulled along with it. Therefore, the movement of plunger 1403 translates into the movement of link portions 1300A and/or 1300B, and that movement translates into the movement of physical object(s) 1302. When the magnetic field is inactive—i.e., when no voltage is applied across terminals 1401A and 1401B—the force applied to plunger 1403, and therefore link portions 1300A and/or 1300B, disappears.

In some cases, plunger 1403 may then move in a direction opposite to the first direction (a "second direction") to return to its original position. To move plunger 1403 back to its original position, a spring may be employed as described below. Additionally or alternatively, if physical object(s) 1302 is pushing against another component with some tension (e.g., a rubber ring), that component may exert a force back on physical object(s) 1302, thereby moving it back to its original position, and, by extension, forcing plunger 1403 back to its original position as well.

In some embodiments, a spring may be placed within casing 1402 to help return plunger 1403 to its original position outside of the solenoid's core. Such a spring may be compressed when plunger 1403 is pulled into casing 1402, and its subsequent decompression may force plunger 1403 back out of casing 1402. The force applied to plunger 1403 by the spring may be in the second direction. Accordingly, when the magnetic field within casing 1402 ceases, link portion 1300A moves outwardly from casing 1402, thus causing physical object(s) 1302 to also move in the second direction.

Figure 15:
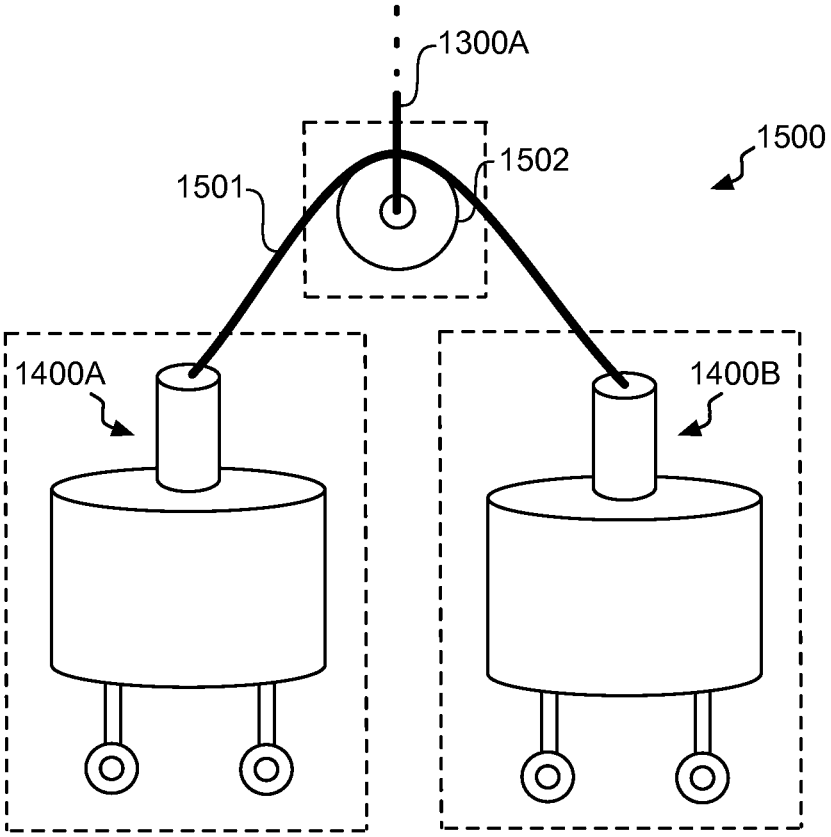
FIG. 15 is a three-dimensional diagram of an example of a dual actuator according to some embodiments.

FIG. 15 is a diagram of an example of a dual actuator 1500 according to some embodiments. In this illustration, two single actuators 1400A and 1400B may make up actuator(s) 403 of FIG. 13. More generally, however, any number N of single actuators may be used. Here actuators 1400A and 1400B are connected together by cable 1501, which is distinct from link portions 1300A and 1300B of FIG. 13. Cable 1501 is routed through pulley 1502, which is in turn coupled to link portion 1300A.

Similarly as before, link portions 1300A and/or 1300B couple actuator(s) 403 to physical object(s) 1302, and are therefore configured to translate movement between actuators 1400A/B and physical object(s) 1302. More specifically, when either of actuators 1400A and 1400B's plungers is pulled into its respective solenoid core, pulley 1502 is also pulled closer to respective one(s) of actuator(s) 1400A and/or 1400B. This movement of pulley 1502 exerts a force on link portion 1300A, and that force translates to movement of link portions 1300A and 1300B, and therefore movement of physical object(s) 1302.

In some embodiments, either or both of actuators 1400A and 1400B may be activated at any given time. Activating actuators 1400A and 1400B may simultaneously translate into more movement of pulley 1502 than when only one of actuators 1400A or 1400B is activated at a time. A larger movement of pulley 1502 translates into more movement of the link, and therefore faster movement of physical object(s) 1302. Accordingly, in some implementations, the use of N actuators may enable different lengths and/or speeds of movement in physical object(s) 1302.

Figure 16:
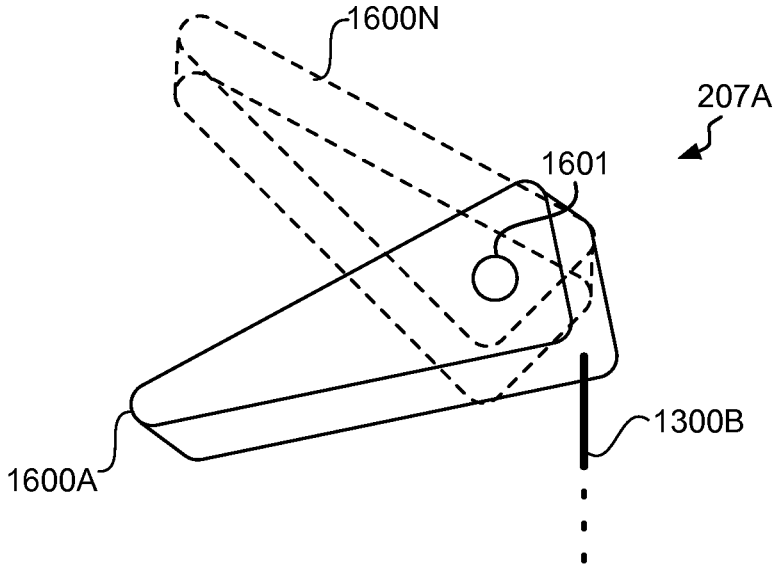
FIG. 16 is a three-dimensional diagram of an example of a remotely actuated flipper according to some embodiments.

FIG. 16 is a diagram of an example of a remotely actuated flipper 207A. In some embodiments, flipper 207A may be used as physical object(s) 1302 of FIG. 13. Here, flipper 207A pivots or rotates around point or post 1601 to assume one of two or more positions 1600A-N (or any other position in between) depending upon the force applied by link portion 1300B, which in turn depends upon the operation of actuator(s) 403, also shown in FIG. 13.

In some embodiments, post 1601 may be used to mount flipper 207A to a portion of hybrid playfield 104 that does not move when flipper 207A rotates around post 1601. This mounting can include, for example, a metal cylinder connected to a surface of pinball machine 101. In some cases, flipper 207A may be made of a single material, such as plastic, wood, metal, or any other suitable material. In other embodiments, however, flipper 207A may include multiple components and/or multiple materials. For example, flipper 207A may have a plastic body with a ball bearing mounted such that it fits around post 1601.

Here, link portion 1300B is coupled to a portion of flipper 207A other than post 1601 (that is, the actual flipper bat) and in such a way that movement of link portion 1300B translates to flipper 207A rotating around post 1601. When link portion 1300B moves towards the bottom of FIG. 16, flipper 207A rotates clockwise, potentially reaching position 1600N or any other intermediate position. When link portion 1300B moves towards the top of FIG. 16, flipper 207A rotates counterclockwise, potentially returning to position 1600A.

In some implementations, flipper 207A may be controlled by a user operating side control(s) 107 to strike and/or apply an acceleration to another object, such as ball 202. The acceleration may be applied to ball 202 directly or indirectly (e.g., in cases where flipper 207A is surrounded by a rubber ring or the like; in which case, the rubber ring applies the force to ball 202). For example, if ball 202 is at a location where part of flipper 207A resides when traveling between positions 1600A and 1600N, flipper 207A may strike ball 202 and therefore apply an acceleration to it by rotating around post 1601 due to the movement of link portion 1300B.

Figure 17:
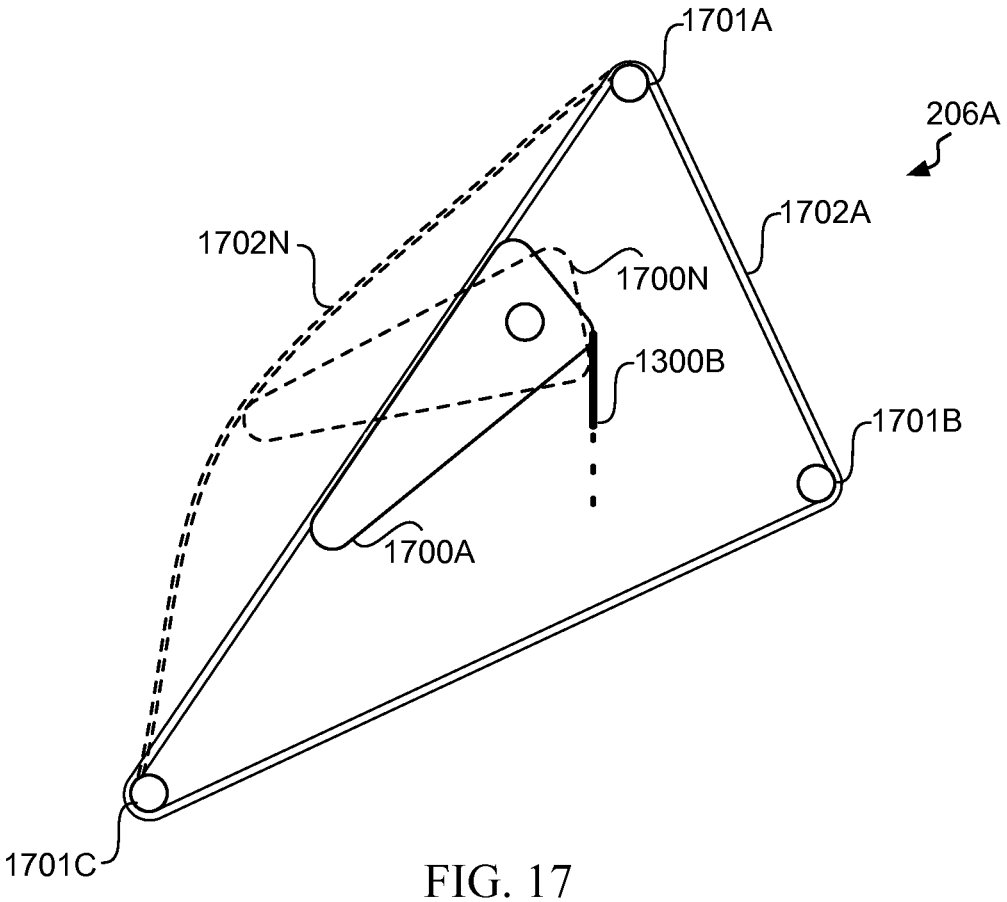
FIG. 17 is a top-view diagram of an example of a remotely actuated slingshot according to some embodiments.

FIG. 17 is a diagram of an example of remotely actuated slingshot 206A. In some embodiments, posts 1701A-C hold rubber ring 1702A or the like in place, and bat 1700A (similar to flipper 207A shown in FIG. 16) may be configured to push against ring 1702A. In that scenario, bat 1700A may be configured to rotate as described in connection with FIG. 16 to assume position 1700N (or any position in between), in which case rubber ring 1702A may assume shape 1702N (or any shape in between). Thus, rubber ring 1702N may strike ball 202 upon control of actuator(s) 403 shown in FIG. 13.

Particularly, when actuator(s) 403 pull link portions 1300A and/or 1300B, bat 1700A may move to position 1700N, thus causing ring 1702A to assume configuration 1702N. Therefore, if ball 202 meets the rubber ring while the rubber ring is traveling between positions 1702A and 1702N, slingshot 206A may strike ball 202 and therefore apply an acceleration to it. Then, when actuator(s) 403 stop pulling link portions 1300A and/or 1300B, bat 1700N returns to its original position 1700A.

As described, FIGS. 16 and 17 present embodiments of physical object(s) 1302 of FIG. 13. It should be noted, however, that these embodiments are shown only by way of illustration, and that numerous other embodiments and variations are contemplated. In some cases, physical object(s) 1302 may move in a single direction, whether along a straight line or around a point. In other cases, physical object(s) 1302 may move in multiple directions, sometimes simultaneously, and other times only one direction at a time. It should also be noted that movement of physical object(s) 1302 is often, but not always, intended to strike and apply an acceleration to another object (e.g., ball 202).

In some implementations, physical object(s) 1302 may contain one or more springs or other tensioning devices to help apply movement to component(s) coupled to link portions 1300A and/or 1300B. For example, in FIGS. 16 and 17, a spring may be added to help return flipper 207A and/or slingshot 206A to its original position once the force being exerted by link portions 1300A and/or 1300B goes away. The force therefore being applied by the spring may subsequently cause flipper 207A and/or slingshot 206A to exert a force on link portions 1300A and/or 1300B, which translates to a force on components actuator(s) 403. In this manner, the system may be reversed in that physical object(s) 1302 now act to provide a force on link portions 1300A and/or 13008 in order to produce movement in actuator(s) 403. However, components of actuator 403 may not necessarily be moved in order to strike and apply an acceleration to another object. In various embodiments, the movements caused in actuator(s) 403 by the movements of physical object(s) 1302 are to return components within actuator(s) 403 to their original positions.

Generally speaking, it should be noted that components within actuator(s) 403 or components within physical object(s) 1302 need not be located in the same general vicinity or be directly attached to each other. In other words, actuator(s) 403 and physical object(s) 1302 may be made up of many components that are located far apart from each other.

Furthermore, in some embodiments, one or more physical object(s) 1302 may be deployed within hybrid playfield 104. As such, the presence of electronic display 202 and/or tracking system 300 may prevent physical object(s) 1302 from being directly coupled to the playing surface of playfield 104. To address these and other concerns, FIGS. 18-20 describe systems and methods of suspending or floating physical object(s) 1302 within hybrid playfield 104.

Figure 18:
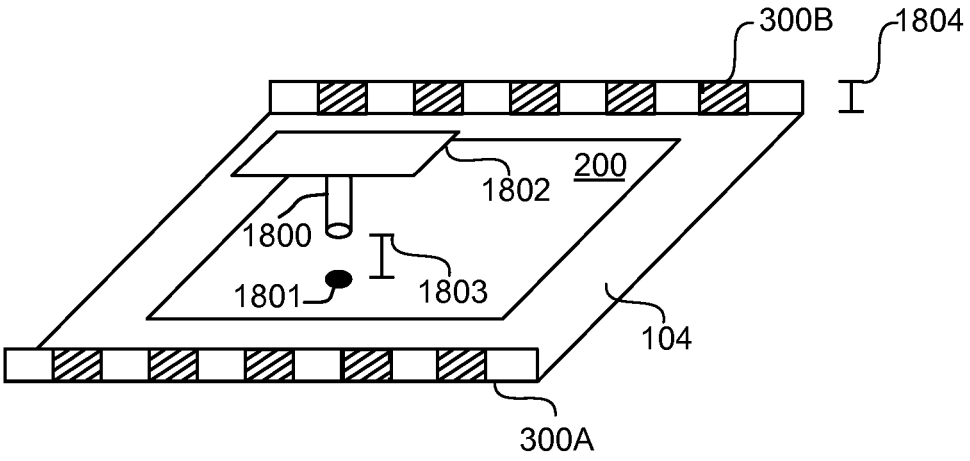
FIG. 18 is a three-dimensional, auxiliary view of an example of a suspended physical object in a hybrid playfield according to some embodiments.

In that regard, FIG. 18 is a diagram of an example of a suspended or floating physical object 1800 in hybrid playfield 104 according to some embodiments. Specifically, object 1800 may be a metal post used to prevent ball 202 from traveling into a part of playfield 104 that is blocked by object 1800. In some cases, object 1800 may include a rubber ring or the like. In order to keep the assembly from moving or breaking when ball 202 hits it, traditional mounting techniques would involve screwing directly into playfield 104 or screwing into a nut located underneath playfield 104; thus causing object 1800 to appear to rise up from playfield 104.

In contrast, here object 1800 is suspended within playfield 104 above electronic display 200, thus appearing to be floating above the surface of playfield 104. Particularly, object 1800 is mounted onto surface 1802, which in this case may be a portion of a playfield cover or some other non-playable area, and hangs down from surface 1802. Point 1801 indicates the location of playfield 104 where object 1800 would touch electronic display 200 were it long enough to do so; and gap 1803 illustrates the distance between the tip of object 1800 and point 1801.

There may be a number of reasons why one may want object 1800 to appear as if it were floating in a pinball machine. For example, it may not be possible to mount the assembly in the desired location on playfield 104. In FIG. 18, for instance, electronic display 200 makes it impossible to mount object 1800 assembly in the desired location on playfield 104. In other cases, components other than an electronic display may block object 1800.

Also, one may wish to allow certain items to pass below the assembly, closer to the surface of playfield 104. Still referring to FIG. 18, tracking system components 300A and 300B may include transmitters and receivers that transmit and receive beams of light, for example, as described in FIG. 3. Thus, the height 1804 of components 300A and 300B may be smaller than the gap 1803 between object 1800 and point 1801 so as to allow components 300A and 300B to communicate with each other while still blocking ball 202 from entering a specific part of playfield 104 (e.g., the diameter of ball 202 may be greater than gap 1803). In contrast, if object 1800 had been mounted directly on the surface of playfield 104, object 1800 would at least partially block communications between components 300A and 300B, thus creating a blind spot around which tracking system 300 would be unable to track the movement of ball 202.

There are a number of ways to mount floating pinball assemblies to provide the illusion that objects or assemblies are floating, for example, by keeping surface 1802 out of view from the player's perspective. In that regard, FIGS. 19A-C are diagrams of components configured to suspend object 1901 in hybrid playfield 104 according to some embodiments.

Figure 19A:
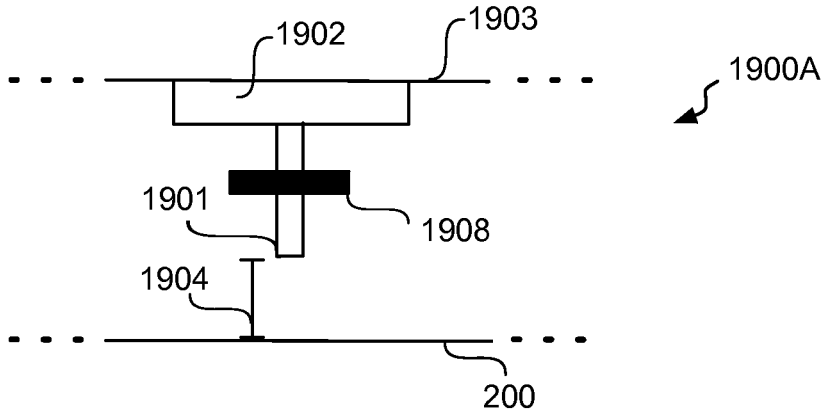
FIGS. 19A-C are side-view diagrams of components configured to suspend a physical object in a hybrid playfield according to some embodiments.
Figure 19B:
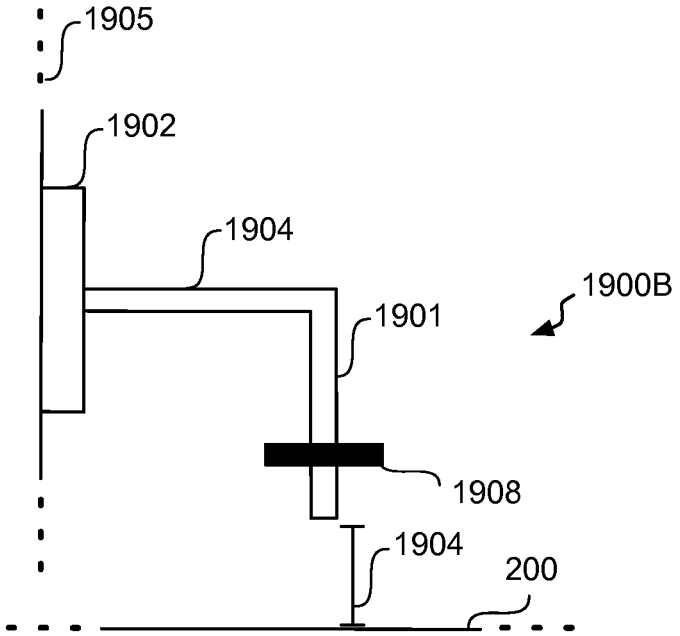
Figure 19C:
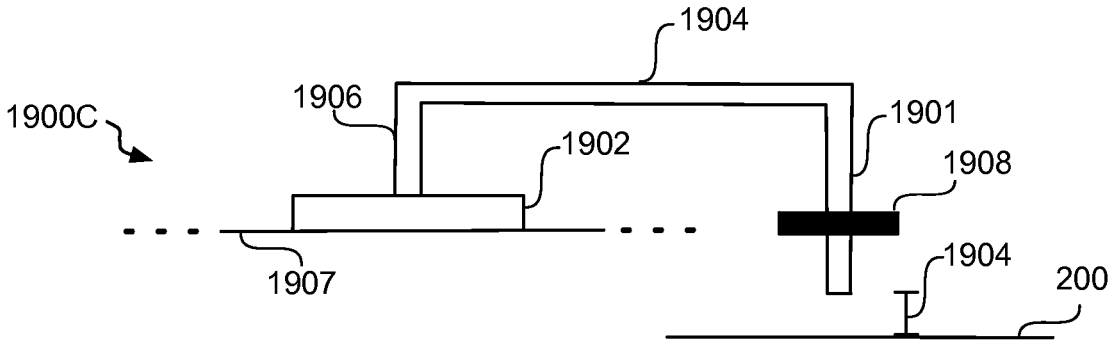

In example 1900A of FIG. 19A, mount 1902 holds object 1901 having rubber ring 1908 above electronic screen 200 with gap 1904. Mount 1902 may be attached to cover 1903. In some cases, at least mount 1902 and/or cover 1903 may be made of glass, plastic, LEXAN, PLEXIGLAS, acrylic or other transparent or translucent materials so as to give the impression that object 1902 is floating. As to example 1900B of FIG. 19B, mount 1902 is vertically positioned and mounted against side wall 1905 of pinball machine cabinet 101. Thus, arm 1904 may extend horizontally away from side wall 1905 to object 1901. In some cases, at least mount 1902, side wall 1905, and/or arm 1904 may be made of glass, plastic, LEXAN, PLEXIGLAS, acrylic or other transparent or translucent materials. With respect to example 1900C of FIG. 19C, mount 1902 is horizontally positioned and mounted against horizontal surface 1907 of the pinball machine distant from electronic display 200, out of sight from the player's perspective. Thus, vertical arm 1906 is coupled to horizontal arm 1904, which in turn is coupled to object 1901. Again, at least mount 1902, vertical arm 1906, and/or horizontal arm 1904 may be made of glass, plastic, LEXAN, PLEXIGLAS, acrylic or other transparent or translucent materials.

It should be noted that, in the foregoing examples, the assembly that includes object 1901 and ring 1908 (i.e., the object(s) with which ball 202 makes contact) are directly coupled to non-playable surfaces of the pinball machine (e.g., side wall 1905, etc.), that is, surfaces other than the playable surfaces that are accessible to ball 202 during the normal course of a pinball game, and where the pinball game is actually played (e.g., including a surface immediately above electronic display 200). Moreover, the mounting is done in such a way that the items in the assembly appear to be hanging or floating from the player's perspective. In some cases, object 1901 may itself be made of glass, plastic, LEXAN, acrylic or other transparent or translucent materials, thus giving the impression that ring 1908 is floating.

Floating assemblies may have few items, such as posts and rubber rings, or may be very complex with numerous items, including combinations of fixed and moving parts. For example, flipper 207A may be made into a floating assembly by inverting the typical installation and mounting it from above, similar to how the post 1901 is mounted in FIGS. 18 and 19A. Slingshot assembly 206A may also be suspended or mounted from above.

Figure 20:
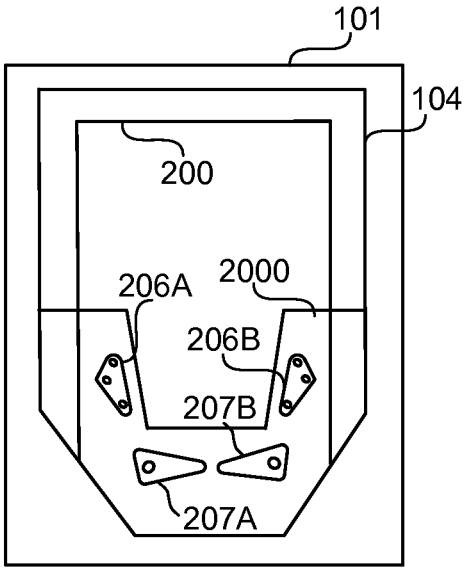
FIG. 20 is a top-view diagram of an example of a surface configured to suspend physical objects in a hybrid playfield according to some embodiments.

FIG. 20 is a diagram of an example of intermediate surface 2000 configured to suspend physical objects in hybrid playfield 104 according to some embodiments. Particularly, flippers 207A and 207B, as well as slingshots 206A and 206B, are mounted on intermediate surface 2000, which may be located at an intermediary height between a cover or lid of the machine, and the playable surface of playfield 104. In some embodiments, components of flippers 207A/B and/or of slingshot posts 206A/B, as well as intermediate surface 2000, may be made of transparent or translucent materials. Intermediate surface 2000 may also hang over the playable surface of playfield 104, anchored to either the side of pinball machine cabinet 101 or to other items out of view from the player.

In the example of FIG. 20, electronic display 200 is embedded into playfield 104 directly below assemblies 206A/B and/or 207A/B. Because traditional non-floating assemblies 206A/B and/or 207A/B would need to be mounted directly to playfield 104, having electronic display 200 in the playfield makes it impractical to use the traditional non-floating assemblies. Floating assemblies 206A/B and/or 207A/B provide similar characteristics to non-floating ones, but are mounted in a way that does not interfere with electronic display 200. Further, by making most of the items in the assembly out of acrylic, or other transparent or semi-transparent material, the player can still see graphics and other items being displayed on electronic display 200, even directly under the floating assemblies 206A/B and/or 207A/B.

Another embodiment may contain some or all of the following items floating near one or both sides of playfield 104: posts, rings, switch targets, guide rails, and other items otherwise used in pinball machines. Once again, a floating assembly with these items may be used due to the inability to mount the items directly to playfield 104, such as in the case of the playfield containing electronic display 200 or other items. It might also be used so that they do not obstruct the path of infrared beams going across the playfield, near the playable surface of playfield 104. Such infrared beams may be used to detect the position of ball 202 as it moves across the surface of playfield 104. Using traditional non-floating assemblies mounted into the playfield itself would not work, because assemblies would block infrared beams, rendering the tracking system at least partially useless.

In summary, floating pinball assemblies may generally operate as their non-floating pinball counterparts, but they present the illusion, from the player's perspective, that they are floating above the playable surface of playfield 104 or above other items mounted to the playfield. They therefore enable the use of features that would not otherwise be usable in a pinball machine, such as electronic display 200 embedded into playfield 104 in areas that are typically used for assembly mounting, or tracking systems whose infrared beams need to travel through areas generally populated by traditional non-floating assemblies.

In some embodiments, a plastic material may be used instead of the more traditional glass used to cover the playfield of a pinball machine. For many decades, pinball machines have included what's termed "playfield glass," which is a sheet of glass, typically tempered, that acts as the top surface of a pinball machine. The glass serves many purposes, such as helping to enclose the playfield so items in the game, such as pinballs, cannot escape the enclosure, so outside items, such as players' hands, cannot enter the enclosure, to muffle sounds coming from the machine, and many others. Traditionally, a pinball machine with a glass playfield cover has a glass lid that slides into grooves or slots in the pinball machine cabinet.

There are a number of problems associated with the use of playfield glass. For instance, the glass is susceptible to breaking, either when an objects strikes the glass or when the glass is being handled by a person, often when removing or reinstalling the glass. Tempered glass is typically used to eliminate sharp, dangerous shards of glass from injuring people when the glass breaks, but this has the unfortunate side effect of creating thousands of tiny pieces of glass that need to be cleaned up.

Another problem with glass is that its optical properties typically cause light to be reflected brightly, resulting in issues with glare. Some glass suppliers have started coating the glass with anti-glare materials to reduce this issue, but the result is a significant price increase, making the glass impractical for non-wealthy pinball machine owners. A better solution for the pinball machine enclosure is some form of a plastic material rather than glass. Examples of suitable plastic materials include, but are not limited to, LEXAN, acrylic, and PLEXIGLAS. These plastic products are each significantly stronger than glass, and therefore less susceptible to breaking. LEXAN is typically 250 times stronger than glass, and acrylic is typically 5 times stronger than glass. In either case, it is practically impossible for one of these plastics to be broken by ball 202 in a pinball machine or by manual handling of the glass.

Further, the optical properties of these plastics are significantly different then glass. Sheets of these plastics are nearly transparent and do not typically result in reflections nearly as bright as they do with glass. For extreme cases, non-glare plastics can be used. Some non-glare plastics are regular plastics coated with a non-glare material, and other non-glare plastics are manufactured directly with non-glare properties. In both cases, non-glare plastics are typically much less expensive than non-glare glass with similar optical properties relative to light reflections and glare.

Another problem with using regular glass as the playfield cover is that it severely limits mounting options. It is difficult to use hardware (screws, pins, etc.) to secure the glass to anything else on the pinball machine's cabinet because installing the hardware introduces the strong possibility of breaking the glass. Therefore, playfield glass is usually installed on a pinball machine by sliding it into a channel and then installing a so-called lock-down bar to keep the glass from sliding back out. This unfortunately limits the possibilities designers have when designing pinball cabinets.

Plastic playfield covers eliminate these, and other problems. Installing hardware into plastic does not carry the same risk of breakage as it does with glass. Plastics may be drilled and screw-mounted much more easily than glass. Therefore, plastic playfield covers enable designers to create and build new types of pinball machine cabinets and enclosures. While a plastic playfield cover may still be slid into a channel similarly as glass, it may also be mounted to portions of the cabinet itself. Moreover, the use of plastics may, in some cases, facilitate the mounting of one or more components (e.g., slingshots, flippers, etc.) on the lid.

Figure 21:
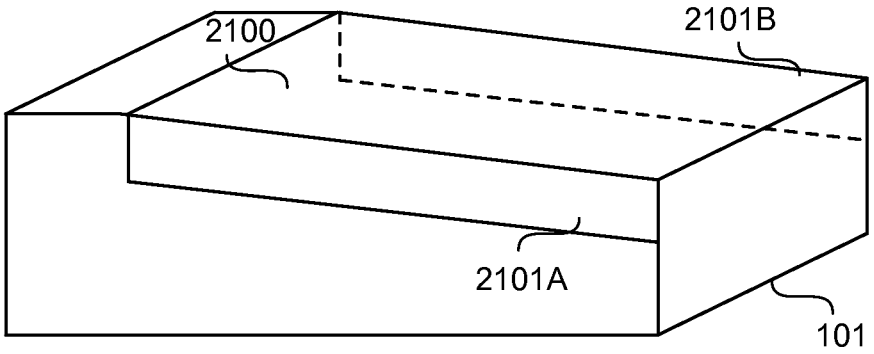
FIG. 21 is a three-dimensional, auxiliary view of a cabinet with an example of a plastic cover or lid according to some embodiments.

FIG. 21 is a three-dimensional, auxiliary view of pinball cabinet 101 with an example of a plastic cover or lid 2100 coupled to cabinet 101 via side rails 2101A/B, according to some embodiments. Here, the entire section including plastic cover 2100 and side rails 2101A/B is removable from the rest of the pinball machine cabinet 101.

Figure 22:
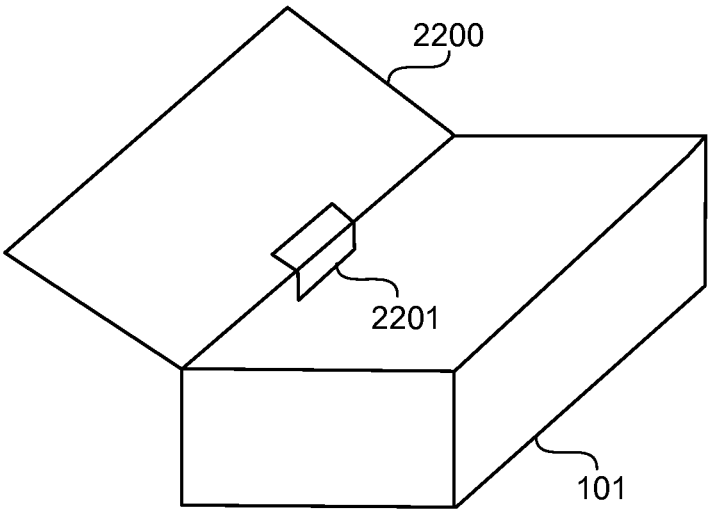
FIG. 22 is a three-dimensional, auxiliary view of a cabinet with another example of a plastic cover or lid according to some embodiments.

FIG. 22 is a three-dimensional, auxiliary view of another cabinet 101 with an example of a plastic cover or lid 2200 coupled to cabinet 101 via lateral hinge 2201, according to some embodiments. In some cases, hinge 2201 may be located in other sides of cover 2200, thus allowing cabinet 101 to be opened by lifting on side of cover 2200. Plastic cover 2200 may be mounted to cabinet 101 in many other ways too, including combinations of some of the previously described ways.

To summarize, the use of plastic as the material to be used for a pinball playfield cover may eliminate many of the problems associated with using glass, risk of breakage, optical reflections and glare, restrictive mounting, and without significantly reducing material costs.

It should be understood that the various operations described herein, particularly in connection with FIGS. 7-12, may be implemented in software executed by processing circuitry, hardware, or a combination thereof. The order in which each operation of a given method is performed may be changed, and various elements of the systems illustrated herein may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. For example, although presented in the context of pinball machines, various systems and methods described herein may be implemented in other types of amusement games. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A pinball machine, comprising:

a physical object configured to directly physically interact with a pinball during a pinball game, wherein the physical object is over and vertically within a playfield of the pinball machine, wherein the physical object is suspended by a component to form a gap between the playfield and a point of a combination of the physical object and at least a portion of the component directly over the playfield, wherein the point of the combination is most proximate to the playfield, wherein the component is coupled to an area other than any playable surface accessible to the pinball during the pinball game and is disconnected from any playable surface of the playfield; and a tracking system comprising a transmitter and a detector both disposed above the playfield, wherein the tracking system is operable to determine a position, a speed, and a direction of movement of the pinball, wherein the transmitter is positioned and operable to transmit electromagnetic energy in a line-of-sight to the detector through the gap when the pinball is not in the line-of-sight.

2. The pinball machine of claim 1, wherein the physical object includes a post, flipper, slingshot, target, or rail.

3. The pinball machine of claim 1, wherein the playfield includes an approximately horizontal surface having an electronic display visible to a player during the pinball game, the electronic display configured to render one or more virtual objects in response to a movement of the physical object.

4. The pinball machine of claim 3, wherein the component includes a transparent or translucent portion located above the electronic display.

5. The pinball machine of claim 3, wherein the area to which the component is coupled includes an intermediate surface approximately parallel to the approximately horizontal surface, the intermediate surface including a transparent or translucent portion located above the electronic display.

6. The pinball machine of claim 1, wherein the area to which the component is coupled includes a playfield cover or lid, and wherein the playfield cover or lid is plastic.

7. The pinball machine of claim 1, further comprising an actuator coupled to the physical object via a flexible link, the physical object configured to move within the playfield under control of the actuator.

8. A pinball machine comprising:

a playfield surface on and over which a pinball rolls during normal pinball gameplay; a cover disposed over the playfield surface, wherein the cover is coupled to and supported by a non-playable surface;

a physical object disposed between the playfield surface and the cover, the physical object to directly physically interact with the pinball during the normal pinball gameplay;

a component suspending the physical object above the playfield surface, the component being transparent or translucent, the component being mechanically coupled to and supported by a non-playable surface on and over which the pinball does not roll during the normal pinball gameplay, neither the component nor the physical object contacting the playfield surface, a gap being disposed vertically and directly between the playfield surface and a lowermost point of a combination of the physical object and at least a portion of the component directly over the playfield surface;

a tracking system comprising a transmitter and a detector both disposed between the playfield surface and the cover, wherein the tracking system is operable to determine a position, a speed, or a direction of movement of the pinball during the normal pinball gameplay, wherein the transmitter is positioned and operable to transmit electromagnetic energy in a line-of-sight to the detector through the gap when the pinball is not in the line-of-sight; and wherein said non-playable surface which supports said cover is not on said playfield and does not interfere with said tracking system.

9. The pinball machine of claim 8, wherein the physical object includes a post, flipper, slingshot, target, or rail.

10. The pinball machine of claim 8, wherein the non-playable surface to which the component is mechanically coupled includes an intermediate surface approximately parallel to and outside of the playfield surface.

11. The pinball machine of claim 8, wherein the non-playable surface to which the component is mechanically coupled includes an intermediate surface approximately perpendicular to the playfield surface.

12. The pinball machine of claim 8, wherein the non-playable surface to which the component is mechanically coupled is a surface of the cover, wherein said playfield surface comprises a width, and wherein the cover extends the entire width of the playfield surface.

13. A pinball machine comprising: a cover, wherein the cover is coupled to and supported by a non-playable surface;

a playfield surface disposed under the cover, the playfield surface being configured to allow a pinball to roll on and over the playfield surface during normal pinball gameplay;

amount attached to and supported by a non-playable surface, the non-playable surface being configured to not allow the pinball to roll on and over the non-playable surface during the normal pinball gameplay, the mount being translucent or transparent, at least a portion of the mount being disposed directly over the playfield surface;

a physical object supported by the mount and disposed between the playfield surface and the cover, the physical object being configured to directly contact the pinball during the normal pinball gameplay, neither the mount nor the physical object directly contacting the playfield surface, a gap being disposed vertically and directly between a lowermost point of a combination of the at least the portion of the mount and the physical object;

a tracking system comprising a transmitter and a detector both disposed between the playfield surface and the cover, wherein the tracking system is operable to determine a position, a speed, or a direction of movement of the pinball, wherein the transmitter is positioned and operable to transmit infrared energy in a line-of-sight to the detector through the gap when the pinball is not in the line-of-sight; and wherein said non-playable surface which supports said cover is not on said playfield and does not interfere with said tracking system.

14. The pinball machine of claim 13, wherein the physical object includes a post, flipper, slingshot, target, or rail.

15. The pinball machine of claim 13, wherein the non-playable surface to which the mount is attached includes an intermediate surface approximately parallel to and outside of the playfield surface.

16. The pinball machine of claim 13, wherein the non-playable surface to which the mount is attached includes an intermediate surface approximately perpendicular to the playfield surface.

17. The pinball machine of claim 13, wherein the non-playable surface to which the mount is attached is a surface of the cover, wherein said playfield surface comprises a width, and wherein the cover extends the entire width of the playfield surface.

* * * * *